US005941305A

United States Patent [19]

Thrasher et al.

[11] Patent Number: 5,941,305

[45] Date of Patent: Aug. 24, 1999

[54] REAL-TIME PUMP OPTIMIZATION SYSTEM

[75] Inventors: William B. Thrasher, Seabrook, Tex.; Steven T. Klein; Mark V. Patton, both of Tulsa, Okla.; Leonardo Mena, El Tigrito, Venezuela

[73] Assignee: Patton Enterprises, Inc., Tulsa, Okla.

[21] Appl. No.: 09/015,744

[22] Filed: Jan. 29, 1998

[51] Int. Cl.[6] ..... E21B 43/12

[52] U.S. Cl. ..... 166/53; 417/15; 417/18; 417/38; 417/63; 417/212

[58] Field of Search ..... 166/250.15, 250.01, 166/65.1, 66, 53; 417/15, 18, 38, 63, 212

[56] References Cited

U.S. PATENT DOCUMENTS

| | | | |
|---|---|---|---|
| 4,490,094 | 12/1984 | Gibbs | 417/42 |
| 4,935,685 | 6/1990 | Justus et al. | 318/798 |
| 5,006,044 | 4/1991 | Walker et al. | 417/12 |
| 5,035,581 | 7/1991 | McGuire et al. | 417/36 |
| 5,589,633 | 12/1996 | McCoy et al. | 417/63 |

*Primary Examiner*—Roger Schoeppel
*Attorney, Agent, or Firm*—Harrison & Egbert

[57] ABSTRACT

A system for optimizing pump operation during oil and gas recovery is provided. By strategically disposing a plurality of sensors along the production tubing and sucker rod strings, pump operation and performance may be monitored real-time. As an important indicia of pump performance, dynamic fluid level is provided to the operator/end user on a real-time basis. Prerequisite to achieving pump optimization, dynamic fluid level and other pertinent data are analyzed and enables corrections to be made in the pumping system during operation. A computer system having sufficient inherent and adaptable expertise is provided to interpret pump conditions based upon a plurality of variables and parameters to increase or decrease pump production and to maintain a dynamic fluid level determined to be optimal or otherwise advantageous by the end user. The system is designed with a panoply of configurations to accommodate remote administration of many wells by using serial communication and remote transmitting devices.

10 Claims, 13 Drawing Sheets

TYPE 2 LOAD CELL
(270)

WITH BEARING LOAD RESPONSE
PUMP RPM GOING UP

PUMP SURFACE DISCHARGE PRESSURE
IN RESPONSE TO INCREASED PUMP DISCHARGE RATE

FLUID LEVEL RELATIVE TO PUMP FLOW RATE

AXIAL BEARING LOAD CHANGE RELATIVE TO FLUID LEVEL WITH CALCULATED FLUID LEVEL IN RESPONSE TO PUMP FLOW INCREASES

PUMP PERFORMANCE CURVE

PRODUCTION RATE VS. FEET OF HEAD (H20)

HORSEPOWER VS. FEET OF HEAD (H20)

REAL-TIME PUMP OPTIMIZATION SYSTEM

BACKGROUND OF THE INVENTION

This invention relates to down-hole pump operation, and more particularly relates to computer systems for optimizing down-hole pump operation during oil and gas recovery.

It is well known in the art that downhole pumps are commonly used to provide supplemental or artificial lifting action to deliver fluids from subsurface formations to the surface of a producing well after reservoir pressure has waned to the extent naturally-available energy is insufficient for production purposes. Accordingly, it is common practice for downhole pump assemblies and associated pump control systems to be used to transport fluids stored in oil and gas wells to the earth's surface.

For example, in U.S. Pat. No. 5,193,985, Escue et al. teach a pump control system having a surface monitoring station for sustaining radio communication with downhole motor-pump assemblies. A plurality of sensors incorporated into each downhole motor-pump assembly send corresponding signals indicative of such variables as temperature and fluid levels for monitoring well and pump conditions. The Escue disclosure elucidates that prior art pump control systems typically monitor minimal variables which have been inadequate for effectively identifying the panoply of pump malfunctions which have adversely affected well production.

For effectively operating downhole pumps during oil and gas recovery, it is imperative that the dynamic pumping fluid level be known. As is well known to those skilled in the art, dynamic pumping fluid level shows the relationship between pumping rate and well productivity, which, in turn, indicates to oilfield practitioners actual well performance. Thus, knowledge of dynamic pumping fluid level provides insight into well productivity, completion, and reservoir condition. Furthermore, comparison of the actual value for a well's dynamic pumping fluid level with theoretical pump output capacity provides crucial insight into the condition and performance of the well's pump system.

As will be readily understood by those skilled in the art, a pump loses efficiency as its various components wear out. During conventional oil well recovery operations, adjusting pump output, which is accomplished by manually adjusting the pump's RPM, is prerequisite to maintaining maximum well productivity. As will be appreciated by those skilled in the art, with no real-time knowledge of well conditions, analysis of well and pump performance is not only limited by lack of timely information, but also is time-consuming and time-intensive. Unfortunately, without automated real-time analysis, catastrophic reduction of well production is the only way to observe changes pertaining to requirements for pump performance.

Heretofore in the art, a well operator must use a periodic expensive and inconvenient sonic fluid level testing to obtain dynamic fluid level. It is common practice, however, due to the inconvenience and expense of these sonic fluid tests, for well operators to estimate the required production rate—and concomitant pump performance—as an attempt to attain maximum well productivity. However, there is a serious risk of excessively low fluid levels will seriously damage an oil well's productivity and also causing damage to pumping equipment. To avoid such risk that potentially disastrous conditions and consequences will occur, operators frequently take conservative actions, thereby correspondingly reducing the probability of achieving maximum oil well production.

As will be appreciated by those skilled in the art, pumps are used in gas wells to remove fluid from the well bore, thereby relieving back pressure on the formation. Such back pressure produced by fluid accumulated downhole, of course, reduces or may even terminate gas well production. These pumps are usually placed by operators below the well perforations, and fluid level is reduced until gas flow out of the well resumes. Typically, gas flow emanating from a gas well will continue until back pressure recurs due to continuing fluid inflow into the well.

Thus, it should be evident to those skilled in the art that, by automating a downhole pump system and providing continuous analysis of well bore and pump conditions, increased gas and oil production of a well heretofore unknown in the art may be attained. Additional benefits include increased life span of pumps and wells and cost reduction attributable to optimized well production and significantly reduced service requirements. Furthermore, the availability of such an automated computer system would also assure that optimum longevity and performance be obtained from pumps used in the progressive cavity pumping applications and the like. Of course, the concomitant advantages pertaining to reduced labor costs and increased production performance of the oil or gas well are self-evident.

It is common knowledge among oilfield production and automation engineers involved in progressive cavity pump systems and the like that there is inherent difficulty associated with effectively automating such pump systems under a real-time closed-loop optimization protocol. Not only is the prerequisite data collection instrumentation cost-prohibitive, but also the information provided by this collected data must be processed and completely analyzed to assure that comprehensive optimization is practicable. Such an oilfield automated pump system has been heretofore unknown in the art. Indeed, attempting to construct such a system using currently available instrumentation generally necessitates a practitioner setting pressure sensors at the pump suction and discharge. This approach for attempting to automate downhole pump systems is evidently expensive and mechanically-elusive because the pump components being controlled are located downhole.

Accordingly, these limitations and disadvantages of the prior art are overcome with the present invention, wherein a computer system is provided that is particularly useful for enabling pumping operations during oil and gas oil well recovery to be monitored and analyzed in real-time, wherein production may be optimized. The pump system taught by the present invention provides oilfield production and automation engineers with a cost-effective comprehensive analytical and automation tool.

SUMMARY OF THE INVENTION

The present invention provides a system for optimizing pump operation during oil and gas recovery. As will be hereinafter described in detail, by strategically disposing a plurality of sensors along the production tubing and sucker rod strings, and related downhole apparatus, pump operation and performance may be monitored real-time. An important indicia of pump performance has been found to be dynamic fluid level. Accordingly, the present invention provides the dynamic fluid level to the operator/end user on a real-time basis.

Prerequisite to achieving pump optimization, the present invention analyzes dynamic fluid level and other pertinent data and affords a convenient means and method for making corrections in the field in the pumping system during operation. It will be understood by those skilled in the art that the present invention includes a computer system having sufficient inherent and adaptable expertise to interpret pump conditions based upon a plurality of variables and parameters to increase or decrease pump production to maintain a dynamic fluid level determined to be optimal or otherwise advantageous by the end user. The computer system taught by the present invention includes an intuitive user data input interface and pump standard operating performance databases. The present invention is designed with a panoply of configurations to accommodate remote administration of many wells by using serial communication and remote transmitting devices.

According to the teachings of the present invention, a methodology has been discovered which enables downhole pump production to be optimized.

As will be hereinafter described in detail, it is accordingly an object of the present invention to provide an integrated mechanical assembly and computer system for achieving real-time downhole pump optimization.

It is also an object of the present invention to provide means and method for monitoring and optimizing dynamic operating condition of a downhole pumping system.

It is also an object of the present invention to provide means and method for monitoring and optimizing dynamic fluid level of a downhole pumping system.

It is another object of the present invention to provide means and method for sustaining a knowledge base of raw data indicative of dynamic operating condition of a downhole pumping system.

It is yet another object of the present invention to provide means and method for applying a knowledge base of raw data indicative of dynamic operating condition of a downhole pumping system to other downhole pumping systems.

It is a feature and advantage of the present invention that downhole pumping operations are monitored and optimized in a manner and with means heretofore unknown in the art.

These and other objects and features of the present invention will become apparent from the following detailed description, wherein reference is made to illustrative examples and related tables and to the figures in the accompanying drawings.

IN THE DRAWINGS

DETAILED DESCRIPTION

A pump optimization system contemplated by the preferred embodiment of the present invention comprises a mechanical assembly including progressive cavity pump ("PCP") means, monitoring means to continuously ascertain the real-time pump performance in a well, and an expert computer system for analyzing pump performance and for concomitant adjustment of pump characteristics so as to optimize well production. As is known to those skilled in the art, a PCP means comprises a stator with a steel tube having an elastomer on the interior of the tube, and a rotor which turns inside the stator. Lengths or strings of oil field production tubing suspend the stator. Lengths or strings of oil field sucker rods suspend the rotor. Such production tubing and sucker rods, of course, are tubular elements routinely used in the oil and gas exploration and recovery industry.

A drive head provides support for the sucker rods, thereby affording a thrust capability, and allows for transmission of rotary torque provided by electric, gas engine, or diesel engine power. As will be understood by those skilled in the art, the length of each of the corresponding production tubing and sucker rod strings varies with the required pump setting depth relative to the location of the oil or gas reservoir. Once installed, the production tubing and stator maintain a static vertical elevation in the well: the tubing and stator must critically space the sucker rod to assure that proper alignment of the rotor in the stator is sustained. As will be appreciated by those skilled in the art, the stator provides a stop pin below its elastomeric section to provide an indication of rotor location during installation. Oil field pulling units or well service "rigs" generally conduct installation. These specialized rigs consist of a mast and mechanical draw-works roughly similar to the draw-works used by a conventional crane.

Figure 1:
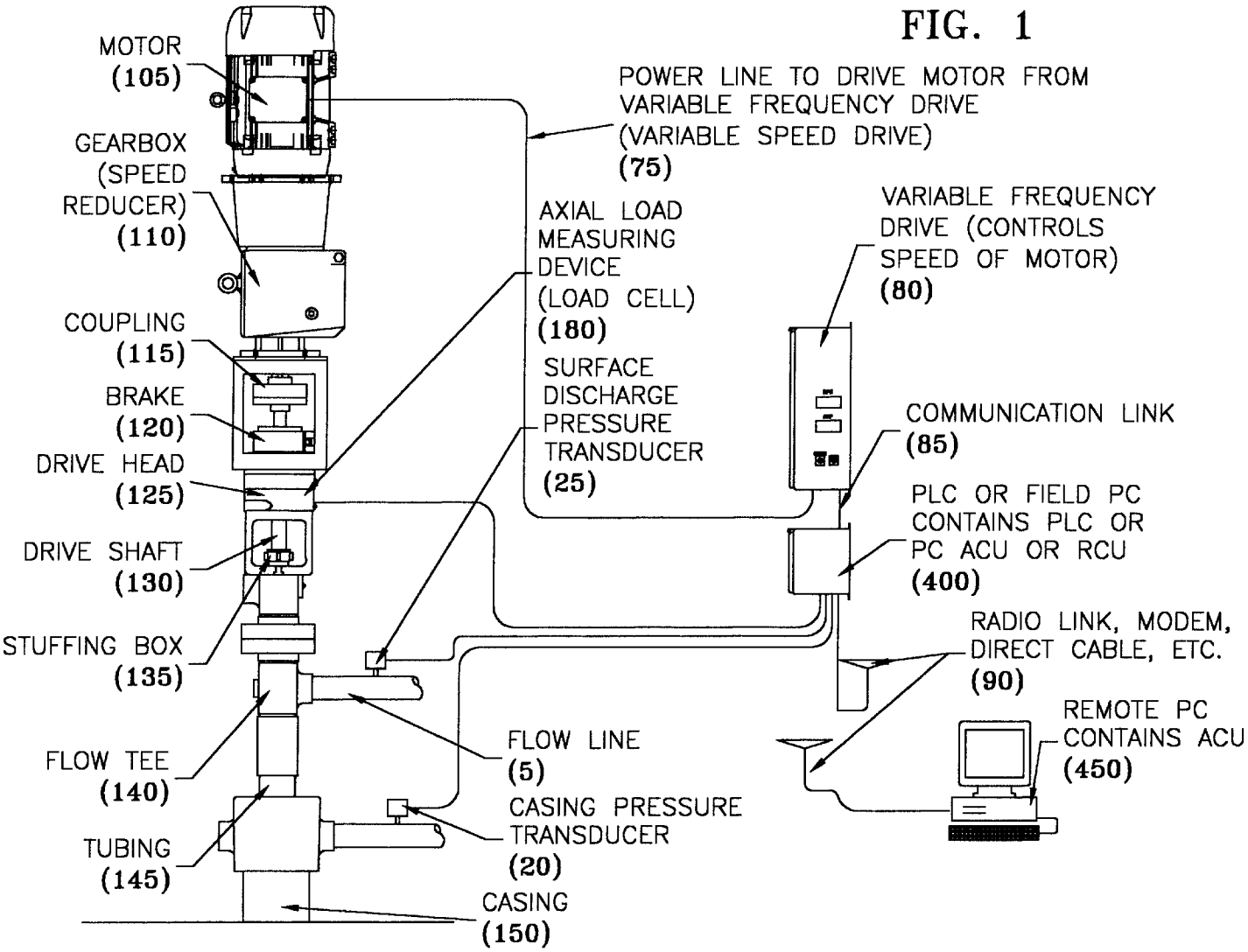
FIG. 1 depicts a simplified schematic of the preferred embodiment of the present invention.
Figure 2:
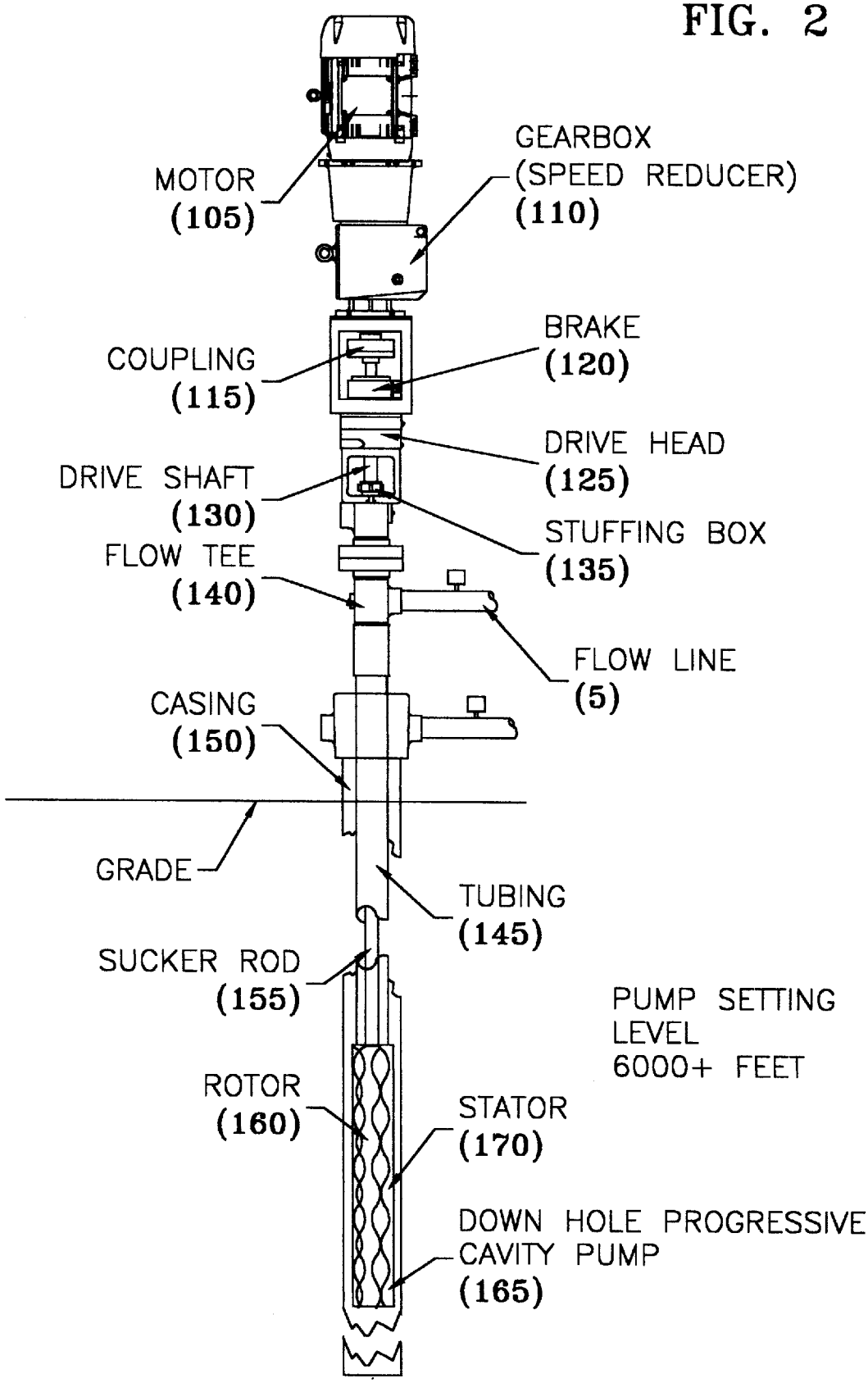
FIG. 2 depicts a simplified schematic of a portion of the preferred embodiment depicted in FIG. 1.

The comprehensive system for real-time optimization of downhole pump performance contemplated by the present invention is depicted in the simplified schematics in FIGS. 1 and 2. More particularly, FIG. 1 shows the surface components comprising the preferred embodiment. In a manner known to those skilled in the art, drive head 125 is fixedly attached to brake 120 and coupling 115. Coupling 115 is coupled to gearbox 110 which, in turn, is attached to drive motor 105. As will be appreciated by those skilled in the art, gearbox 110 controls the speed of motor 105 communicated to drive shaft 130. Flow line 5 branches from the production line at flow tee 140 wherein surface discharge pressure is monitored by transducer 25. Similarly, transducer 20 is disposed on the annular space to monitor casing pressure. Gas may bubble up through casing 150 and, of course, in a manner known in the art, such casing may run to a gas gathering system or may be vented to the atmosphere away from the well to avoid safety hazards and the like. Axial load on drive head 125 is monitored by load cell 180.

As dearly shown, output from surface discharge pressure transducer 25, casing pressure transducer 20, and load cell 180 are electrically communicated to programmable logic controller ("PLC") 400 or a field personal computer ("PC") containing an integrated PLC, a remote control unit ("RCU"), and an advanced control unit ("ACU"), as will be hereinafter described in detail. Communication link 85 is interconnected with PLC 400 and variable frequency drive 80, which controls the speed of motor 105. Power line 75 is in electrical communication with drive motor 105 and variable speed frequency drive 80. The present invention also contemplates communication between PLC 400 and the like with a remote PC 450 containing an ACU, enable by radio link, modem, direct cable connection, etc. Depicted therein is production tubing string 145 contained within casing 150 common to the downhole art.

The real-time pump optimization system of the present invention thus tracks variables providing insight into the relationship between pump discharge pressure and downhole thrust at the drive head. Establishing the amount of the load carried by the drive head thrust bearing has been found to be a key to performing this analysis particularly on a real-time basis. Preferably, a resistive bridge load cell measures this drive head thrust bearing load. Analog outputs from other pressure transducers provide surface discharge pressure and casing pressure. Motor current on the drive head motor is simultaneously monitored. As will be appreciated by those skilled in the art, these analog values are analyzed to establish the dynamic pump operating condition of the pumping system, to establish the dynamic fluid level in the well, and to provide raw data for analyzing operating condition of the pump system.

In the preferred embodiment of the present invention, a PLC or industrial-strength PC acts as the communication center linking the mechanical drive and the expert computer system. As will be understood by those skilled in the art, the PLC is configured to store data and to operate the pump system based on basic information downloaded from the expert computer system. The PLC also provides the interface for administering pump performance from a remote site. It should be evident that, for a non-automated application of the present invention, the PLC may be excluded; under such circumstances, of course, the expert system of the present invention would preferably interface with data-providing instruments at the drive head directly from a portable, field carried computer. As appropriate, in some applications, an industrial PC configured with analog and digital I/O may be used at the field site. It should be apparent that the expert system taught by the present invention would be loaded on this PC, wherein the complete pump optimization system operates in the field at the local site. Using technology known in the art, the PC-contained system or PLC may be administered from a remote location via a modem or radio link.

Referring now to FIGS. 1 and 2, there is depicted a simplified schematic of a preferred embodiment of the downhole rotor-stator assembly which comprises a mechanical aspect of the present invention. As is well known in the art, the term "downhole" is contemplated to mean that an encased device is placed below ground within the annular space of an oil or gas reservoir or well. In a conventional manner also well known to those skilled in the art, casing extends downwards from the wellhead and is perforated at its lower end to enable formation fluid to flow therein and then be forced upwards toward the surface. In particular, formation fluid is conducted to the surface by flowing to the surface inside a production tubing string contained within the casing. Packing means is generally used to seal the annulus between this casing and the production tubing string. Rotor-stator assembly 100 of the oilfield pump system taught by the present invention comprises rotor means 160 and stator means 170. Rotor means 160 is preferably constructed from a high strength, precision-machined, chrome-plated steel external helix. Stator means 170 consists of an internal helix which is preferably precision-molded from a durable synthetic elastomer. A conventional oil and gas recovery installation incorporates such a stator means into the production tubing string 145.

Plurality of American Petroleum Institute ("API") sucker rods 155 are configured to suspend rotor means 160 within stator means 170 and to drive rotor means 160 rotationally. It will be understood that sucker rods 155 suspend rotor means 160 within corresponding stator means 170 and drive rotor means 160 in a rotational direction. That is, as shown in FIG. 2, rotor 160 is driven by sucker rod string 155 which is connected at its lower end to rotor 160 and extends inside production tubing 145 up to the surface. Sucker rod string 155 is driven in a rotary manner by surface drive head 125 that actuates pump means 100. Tubing string 145 contemplated hereunder secures stator 170 as a stationary member of the pump assembly, at a fixed subsurface elevation. FIG. 2 depicts the pump assembly at a level in excess of 6,000 feet below the surface. As will be appreciated by those skilled in the art, when rotor means 160 and stator means 170 are in place, seal cavities are formed. Then, as rotor means 160 turns in corresponding stator means 170, these seal cavities progress in an upwards direction to discharge pumped fluid into tubing string 145.

Progressive cavity pump means 165, a basic component of the preferred embodiment, consists of single helical rotor 160 engaging double helical stator 170 that is attached to the bottom of tubing string 145. Rotor 160 is typically attached to sucker rod string 155 that is suspended and rotated by surface drive 125. Surface-mounted drives 125 support and rotate sucker rod string 155 thereby transferring torque to downhole progressive cavity pump 165. Rotary motion is normally obtained through the action of a pulley and belt drive system that can be either fixed speed or variable speed. Variable speed, of course, may be either mechanical or electrical. As the rotor turns eccentrically within the stator of a progressive cavity pump contemplated by the present invention, a series of sealed cavities forms and progresses from the suction end to the discharge end of the pump in a manner well known in the art. Accordingly, a continuous positive displacement flow is engendered having a discharge rate proportional to the rotational speed of the rotor and the differential pressure across the progressive cavity pump.

Located at the surface of the well is drive head 125 that comprises bearings, seals, etc, which are required to rotate plurality of API rods 155 in a manner known in the art, thus turning rotor means 160 within stator means 170. Since progressive cavity pump 165 contemplated by the present invention is a positive displacement pump, as the rotational speed of pump means 165 varies, the pump output varies proportionally. As will be appreciated by practitioners in the art, oilfield progressive cavity pump applications range significantly as a function of the setting depth of the pump assembly and the pumping rate prerequisite to sustaining the intended fluid output.

Thus, the preferred embodiment of the present invention comprises an assembly of mechanical and raw data collection devices. Drive head 125 comprises a support structure which holds pump system drive shaft 130, and thrust and radial bearings to provide a conventional mechanism to rotate plurality of sucker rods 155 which rotate rotor 160 in stator 170. This assembly provides isolation of pumped fluid F by the means of packing gland or seal 135 to provide manageable discharge of fluid F. Drive head 125 contains radial and axial bearings that conventionally support load L attributable to plurality of rods 155, fluid column F, and pump 165. As is well known in the art, bearings are used to centralize drive head shaft 130. Drive head 125 makes it possible to isolate the elements that bear the load in the axial thrust bearings, and, of course, the drive head itself. This isolation helps measure axial load L by means of hydraulic or electronic instrumentation 400 that is placed between the drive head thrust bearing and the drive head. As is conventional in the art, drive head 125 is configured with conventional devices such as coupling means 115 and gearbox 110 to receive various attachment motors 105, engines and other common prime movers.

Figure 3A:
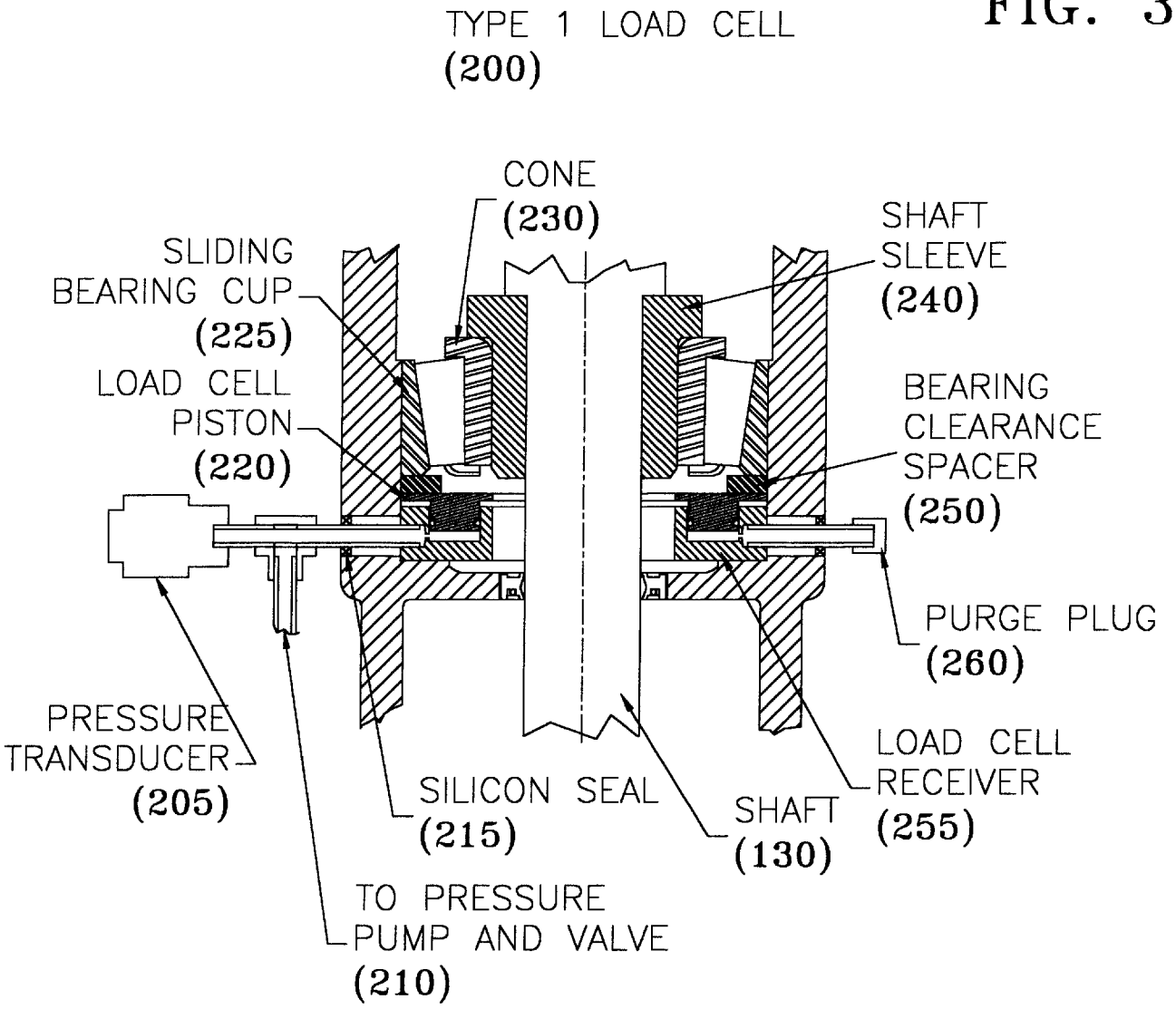
FIG. 3A depicts a frontal cross-sectional view of the drive head portion of the preferred embodiment depicted in FIGS. 1 and 2.
Figure 3B:
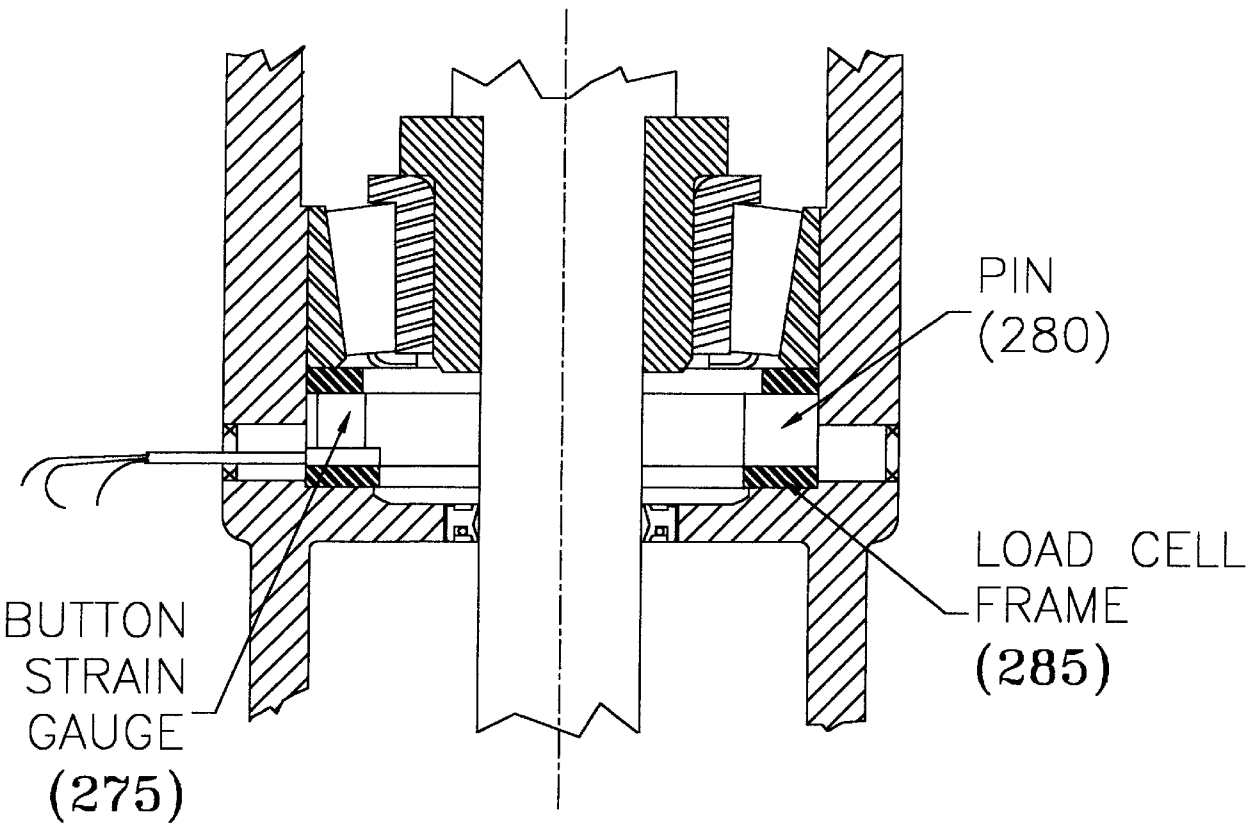
FIG. 3B depicts another frontal cross-sectional view of the drive head portion of the preferred embodiment depicted in FIGS. 1 and 2.

Referring now to the frontal cross-sectional view of drive head 125 and associated components depicted in FIGS. 3A and 3B, it will be understood that an important aspect of the present invention is the mechanical relationship engendered by the affect of pump discharge pressure and downthrust at the drive head relative to the downhole pump system. Indeed, as will be hereinafter described, to monitor this mechanical relationship it has been found to be advantageous to establish a value for suction pressure existing downhole. This data is ascertained by measuring the amount of the load that is carried by the drive head thrust bearing. As will also be understood by those skilled in the art, the present invention uses a suitable load cell, such as a resistive bridge load cell or a hydraulic load cell and an analog pressure transducer to measure this load.

Thus, drive head 125 conventionally includes a bearing chamber for holding both radial bearings and axial bearings, and a is top cover for sealing the system from environmental contaminants and for containing the radial bearing. It will be appreciated that the axial bearing bears the weight of fluid, the plurality of rods, and the pump load. The radial bearings centralize the drive head shaft and provide radial load capacity to the system. As is well known in the art, the top seal means and bottom seal means work in combination to keep grease inside and dirt outside. Braking means 120 prevents back spin when power is no longer driving the sucker rod rotationally. Stuffing box or shaft packing means 135 provides a mechanical fluid seal between the atmosphere and fluid filled tubing 145. This assembly thus enables isolation of pumped fluid F by means of packing gland or seal 135 affording manageable discharge of the fluid. Also shown is load cell 180 which is a mechanical load measuring device.

In the preferred embodiment of the present invention, as shown in the frontal cross-sectional views depicted in FIGS. 3A and 3B, load cell 200 comprises a hydraulic or electronic load cell that is placed beneath thrust bearing cone 230 and cup 225. As will be appreciated by those skilled in the art, there are two prevalent load cells commonly used in the oilfield art: a hydraulic load cell and a strain gauge load cell. Conventional hydraulic load cell 200 depicted therein is contained within casting means 245, shown relative to shaft 130 and shaft sleeve 240. Load cell 200 comprises piston 220 and a corresponding load cylinder, silicon O-ring seals 215, pressure transducer 205, and a conventional inlet valve. Also shown are purge plug 260, bearing clearance spacer 250, outlet means to pressure pump and valve 210, and load cell receiver means 255. As will be appreciated by those skilled in the art, hydraulic load cell 200 is disposed below the axial bearing and the drive head shaft, and provides support thereto. In a manner well known in the art, piston 220 of hydraulic load cell 200 lifts the axial bearing so that load cell piston bears the same load as the axial bearing. As should be evident to those skilled in the art, this load corresponds to the weight of total hydraulic fluid load plus the weight of the plurality of rods submersed in the fluid. The pressure transducer registers this force (attributable to the load) on the load cell piston. The axial load of the system is known because of the fundamental relationship between pressure and force:

$$\text{Load, LB} = pa \times Phs$$

where LB is the load of system due to the sum of weight of fluid column, rods, the pump, etc.; pa is the area of the load cell piston; and Phs is the pressure registered by the load cell.

Now referring specifically to FIG. 3B, in another embodiment of the present invention, load cell means 270 comprises an electronic strain gauge load cell comprising button strain gauge 275, load cell frame 285, and contact pins 280. According to the present invention, this system is found below and in support of the axial bearing and the drive head shaft, wherein strain gauge 275 is placed on the edge of load cell frame 285. Two contact pins 280 with the same altitude are placed on the same centerline from shaft 130 at 120° intervals, thereby being disposed equidistantly from button strain gauge 275. The strain is positioned 0 or 360° with the first pin at 120° and the second pin at 240°. As should be evident to those skilled in the art, this placement allows an equal load to be distributed among these three elements. The load cell frame bears the same load as the axial bearing. This force (load) on the load cell frame is transferred to the button load cell and the two contact pins. The button load cell supports one-third of the total axial load. The strain gauge load cell registers this load. It will be appreciated by those skilled in the art that an advantage of measuring one-third of the total axial load is the reduction of size and associated cost of the strain gauge element imparting physical and economic feasibility to the design.

Also depicted in FIGS. 1–3A is well head discharge pressure transducer 205 which provides an analog value to represent the surface discharge pressure. As will be understood by those skilled in the art, surface discharge pressure is the pressure required to overcome surface restriction or back-pressure existing in the flow line of the gathering system. This surface discharge pressure corresponds to a variable dependent upon such factors as well fluid viscosity, number of operating wells (discharging into the same gathering system), flow line size, flow rate, elevations changes, etc. Casing pressure transducer 120 is shown for providing an analog value representing the pressure on the annular space due to gas associated with petroleum or gas production. Variable frequency inverter 80 provides the ability to adjust the speed of the pump by changing the frequency of the AC voltage supply to the induction motor turning the drive shaft at the drive head, and provides motor current feedback to the computer system taught by the present invention. Also shown is drive motor 105 which provides rotary force to drive shaft, rods and pump components. As will be clear to those skilled in the art, drive motor 105 can be configured as a direct drive, gear motor chain drive, etc, as appropriate for optimum pump performance as contemplated herein.

Figure 4:
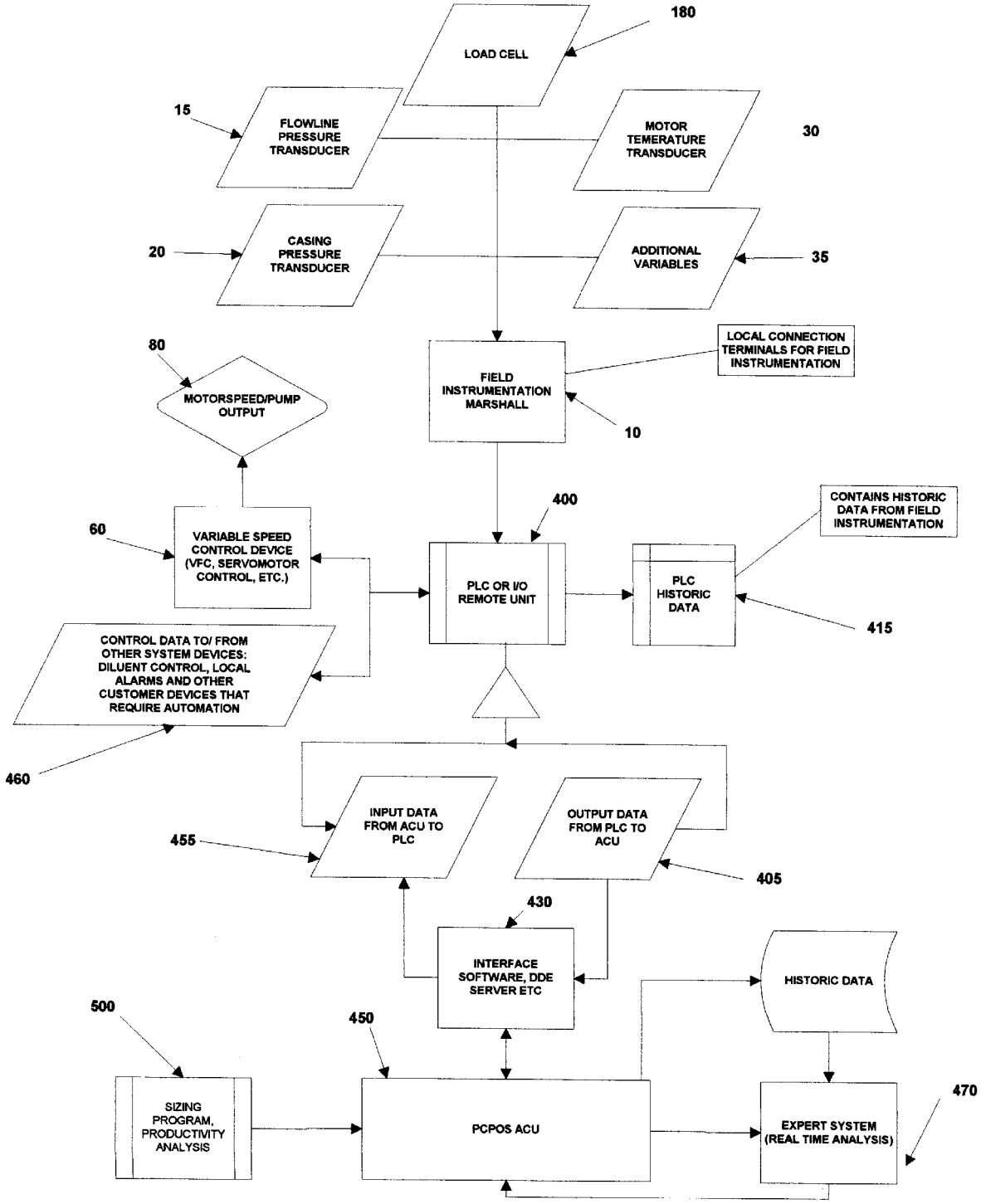
FIG. 4 depicts a block diagram of the logic and data flow of the computerized expert system of the preferred embodiment of the present invention.

Referring now to the block diagram depicted in FIG. 4, the logic and data flow characterizing the expert computer system contemplated by the present invention are depicted. As will be understood by those skilled in the art, the computer system taught by the present invention is comprised of a field instrumentation unit or a field instrumentation marshall ("FIU") 10, a programmable control ("PLC") or remote control unit ("RCU") 400, and an advanced control unit ("ACU") 450. Also depicted are variable speed controller 60, PLC historic data unit 415, software interface unit 430, sizing program/productivity analysis unit 500, and real-time analysis unit 470.

More particularly, referring now to FIGS. 1–2 and 4, FIU 10 receives inputs from load cell 180, flowline pressure transducer 25, casing pressure transducer 20, motor temperature transducer 30, and additional variables 35 as herein described. As also hereinbefore described, surface drive head 125 provides the measurement for the axial load, supported by the axial bearing. FIU 10 consists of the well surface instruments necessary to transmit all of the well operational data to the RCU 400, and is based on industrial instrumentation standards. The RCU 400 performs the basic control rules to optimize the progressive cavity pump system as contemplated under the present invention to protect the pump operation from extreme conditions and to assure the well's continuous operation. The RCU also performs the communication interface between the ACU 450 or SCADA System, based on standard protocols. The ACU 450 corresponds to the expert system contemplated under the present invention, performing the advanced control rules to optimize well production, and performs advanced analysis and diagnostics based on the real-time information coming from the field. The ACU generates control actions over the well and alarm messages on an operator console, followed by a detailed explanation thereof. Representative control actions include adjusting RPMs, adjusting opening percentages for a valve, etc. As will be hereinafter described, the ACU 450 through its real time analysis 470 also provides the user interface with the pump sizing and performance modules 500 contemplated under the present invention.

As will become clear to those skilled in the art, basic rules as contemplated by the present invention comprise rules that adjust pump speed to control production rate to obtain an intended fluid level and to provide alarms and/or shutdowns to prevent damage to expensive pump system components. Motor speed and concomitant pump output 80 is determined via variable control device 60, e.g., servomotor control, using control data to/from other system devices 70 as described herein including diluent control, local alarms, and other site devices that require automation. On the other hand, advanced rules comprise rules generated through the representation of a knowledge-based oilfield experience, wherein production may be maximized, the chance of operational failures may be minimized, potential pump failures and well condition may be ascertained, and appropriate preventative actions for optimized pump operations may be recommended.

As will be understood by those skilled in the art, the ACU taught by the present invention can use RCU information, whether it is directly integrated thereto or interconnected to a SCADA system. Standard interface protocols 430 for stand-alone or network versions such as DDE, TCP/IP, etc., are supported. Connection options include radio links, dedicated or a non-dedicated phone-line modem, or direct connection 90. It will, of course, be understood that the ACU and the RCU may be linked in a dedicated industrial PC located in the field. It will also be understood that the ACU can network, control, and operate a plurality of pump installations contemplated under the present invention.

Thus, it will be appreciated that the present invention provides a computer system (see FIG. 5) for optimizing downhole pump performance using real-time data provided by inexpensive, commonly available transducers and the like that are strategically disposed within the well head assembly as hereinbefore described in detail. Generally, those skilled in the art have sought to automate real-time closed-loop PCP operation, but have been unable to avoid using expensive instruments and the like which have typically been emplaced downhole. Besides providing sufficiently accurate and current data, such an optimization system must also efficiently process and analyze such data so that suitable adjustments may be made in the field in real-time or at least near-real-time.

As will be hereinafter described, software aspects of the preferred embodiment of present invention have been developed in C++ for Microsoft Windows 3.1, 95, or NT platforms, and is compatible with standard TCP/IP, DDE communications protocols, and any application compliant with these protocols. It has been designed with a Client/Server architecture. Of course, any other suitable implementation language on any other platform in the art is within the teachings of the present invention. Artificial Intelligence techniques such as neural networks, fuzzy logic, and genetic algorithms are used to perform the inference engine tasks of the present invention. By way of example, as will be hereinafter described, a fuzzy logic module manages the task of comparison and detection of the variables' conditions. A fuzzy set consisting of four conditions for each variable is used to prevent ambiguous conditions from occurring.

Another aspect of the present invention is the automation analysis and software comprising the expert system and related systems. In the preferred embodiment, analytical tool for progressive cavity pump systems design 22 comprises software that develops mathematical models of a progressive cavity pump well to decide the well potential. Well potential is contemplated by the present invention to correspond to inflow performance ratio (IPR) and the outflow performance ratio (OPR). The correct size of the progressive cavity pump equipment to be used for a well, e.g., pumps, drive heads, rods, etc., is also ascertained by this aspect of the present invention. This analytical tool works on-line, and off-line, and includes a database that makes saving and retrieving actions possible.

Now focusing on well potential, the nodal analysis module of the preferred embodiment allows the generation of both in-flow and out-flow performance ratio curves for the well and well completion. It is possible to set and fix the operating point of the well for analysis of the design, redesign, or operating parameters. Operating parameters include intended rate or fluid level, hydraulic power, mechanical power, electrical power. Studying the well completion is possible using both vertical and horizontal multi-phase flow correlations for light, medium, heavy, or extra-heavy crude oil. By using these analyses, the optimum intended production rate for the well may be determined. Additionally, deciding the necessary pressure differential is possible (Delta P) across the pump; Delta P defines the hydraulic power required by the pump. As will be hereinafter described, determining the suction pressure (fluid level) for optimum well performance is also possible under the present invention. Using a panoply of mathematical correlations, the mechanical loads managed by the drive head and the motor (or other prime mover) can be predicted.

In order to accomplish the pumping optimization objectives of the present invention, friction and density calculations are prerequisite for establishing, in turn, accurate calculations for fluid levels because of the impact of friction and density upon flow-line or surface-discharge pressure. As will be understood by those skilled in the art, friction and density also contribute hydraulic load and resultant mechanical load when involved in pumps producing through a tubular pumping system as contemplated hereunder. Friction losses are considered mechanical in nature because of the natural resultant increase in pressure due to fluid flow through pipe; these values vary with fluid characteristics such as viscosity, tubular dimensions, and pump flow rates. Fluid density calculations obtain the specific gravity or weight of a column of fluid. Establishing values through calculations for the fluid density allows the expert system aspect of the present invention to mathematically establish increased hydraulic loads and buoyancy-impact on suspended sucker rods. As will become evident to those skilled in the art, these values are required to accurately calculate the impact of system variables and to make corrections for accurately enabling fluid level and mechanical interpretations to be made.

Time-related variables used in the computer system taught by the present invention define a predictable mechanical relationship. Indeed, these relationships indicate the potential requirement for adjustment to the operating conditions of the pump or well dynamics. Additionally, these time-value relationships provide historic data for use to analyze pump and well conditions preferably on a real-time basis. As will be appreciated by those skilled in the art, these analyses define event characteristics which may then be stored and used by the Expert System to control, optimize, and predict required adjustments to assurance optimal pump performance. Of course, these events also indicate demands for service and other pump system necessities. Thus, the present invention affords the operator the ability to effectively increase well productivity, reduce down-time, and substantially improve operating economy.

The present invention also addresses the equipment sizing issues that are prevalent in the oilfield. In particular, pump sizing and elastomer type determinations are made based on the pressure and production requirements. The selection is based on the crude oil chemical affinity to available elastomers. As examples, elastomers may be selected having reduced gas permeability or resistance to aromatic hydrocarbon or increased maximum temperature capacities. Similarly, drive head sizing is performed based on the maximum load held by the axial bearing and mechanical power requirements. Mechanical loads are determined by hydraulic requirements of the pump and weight of the rods. Motor selection is based on the maximum amount of power required by the pump. Rod string sizing is based on depth, fluid viscosity, API gravity, torsional load, etc.

Another aspect and advantage of the present invention is rules module 23 based on expertise for optimized operation. Such a collection of rules preferably comprises a dynamic knowledge base which derives from on-field experience to optimize production and diminish failure possibilities. Real-time information constituting field variables including axial load, current motor temperature, well head pressure, and rpms, torque, etc., is communicated to the software aspect of the present invention by means of a standard communications platform. As will be hereinafter described, an analysis is made on that raw data to decide the appropriate control action to be taken. As will be clear to those conversant in the art, such actions include change of pump speed (RPM) or change of opening percentage of a bypass valve, pump shutdown, and system alarms, etc. It will be appreciated that optimization objectives are to achieve continuous, uninterrupted well production; to predict and correct malfunction situations; to lower operating costs; to maximize useful life of the equipment by protecting them or by modifying operating conditions.

As will become evident to those skilled in the art, the diagnosis provided by the present invention (see FIG. 6) is accomplished by an integrated and iterative process of pattern recognition implemented by a panoply of artificial intelligence tools including neural networks, genetic algorithms, fuzzy logic, expert systems, etc. Thus, the on-line closed-loop optimization contemplated by the present invention depends on certain variables which should be automated in a progressive cavity pump well such as: system axial load, rotor RPM, motor current, automatic shutdown and alarms, chemical and diluent injection control, motor winding temperature. As is common in the art, production engineers must keep the axial load value within an operating band and oscillating around a design value. This design value is ascertained from the weights of the rods, the pump, and the fluid column inside the tubing; while the pump minimum submersion level is taken into account. Minimum submersion of a pump is the lowest fluid level in a well that may be allowed for maximum fluid production while causing no risk to well completion.

Diagnosing important events such as pump-off, gas-lock, over-torque, rod string fractures, worn pump elements, and stator swell is readily enabled by the present invention. It will be understood that progressive cavity pump systems are based on a production rate, which is directly related to the pump (rotor) speed. This speed is the same speed of the drive head shaft. Accordingly, by measuring the system RPM, performing an axial load aided production optimization control action is possible. The system taught by the present invention automatically adjusts the RPM as required. Once the RPM adjustment is achieved, the system conducts a RPM check to assure that the correct adjustment was completed. The present invention contemplates that any of the several different ways to achieve RPM measurement including a magnetic pick-up, a serial connection to a variable speed drive, etc., may be used.

By measuring the motor current, the present invention may conveniently perform several operating analyzes such as: predicting or detecting mechanical load conditions, stuck pumps, pumped solids, gas, etc. Furthermore, motor current values provide the ability to monitor the system's electrical system corresponding to balanced loads, phase loss, etc. Of course, under certain circumstances, the system needs to be shutdown as soon as possible. Such conditions typically may include excessively high well head pressure, excessive torque (current), extremely low or high axial loads, etc. Therefore, a means of performing an immediate, automatic shutdown is necessary. Alarms may be provided as preemptive warnings of potential system problems.

By monitoring flow rate and pressure, it has been found to be advantageous to control the amount of chemical or diluent volumes introduced into the well bore or flow line. The chemicals may be required, as is common practice in the art, to prevent corrosion, paraffin build-ups, etc. Diluents are used to control well fluid viscosity. These injection controls can manage the output rate of a chemical injection pump or the opening percentage across a chemical or diluent injection valve. To accomplish such controls, a means of adjusting such valve such as a valve actuator is required. The instrument system complies with any additional instrumentation commonly used for oil well applications. For example, Instruments Society of America (ISA) standards are supported. Similarly, the present invention supports other designs as well.

Figure 5:
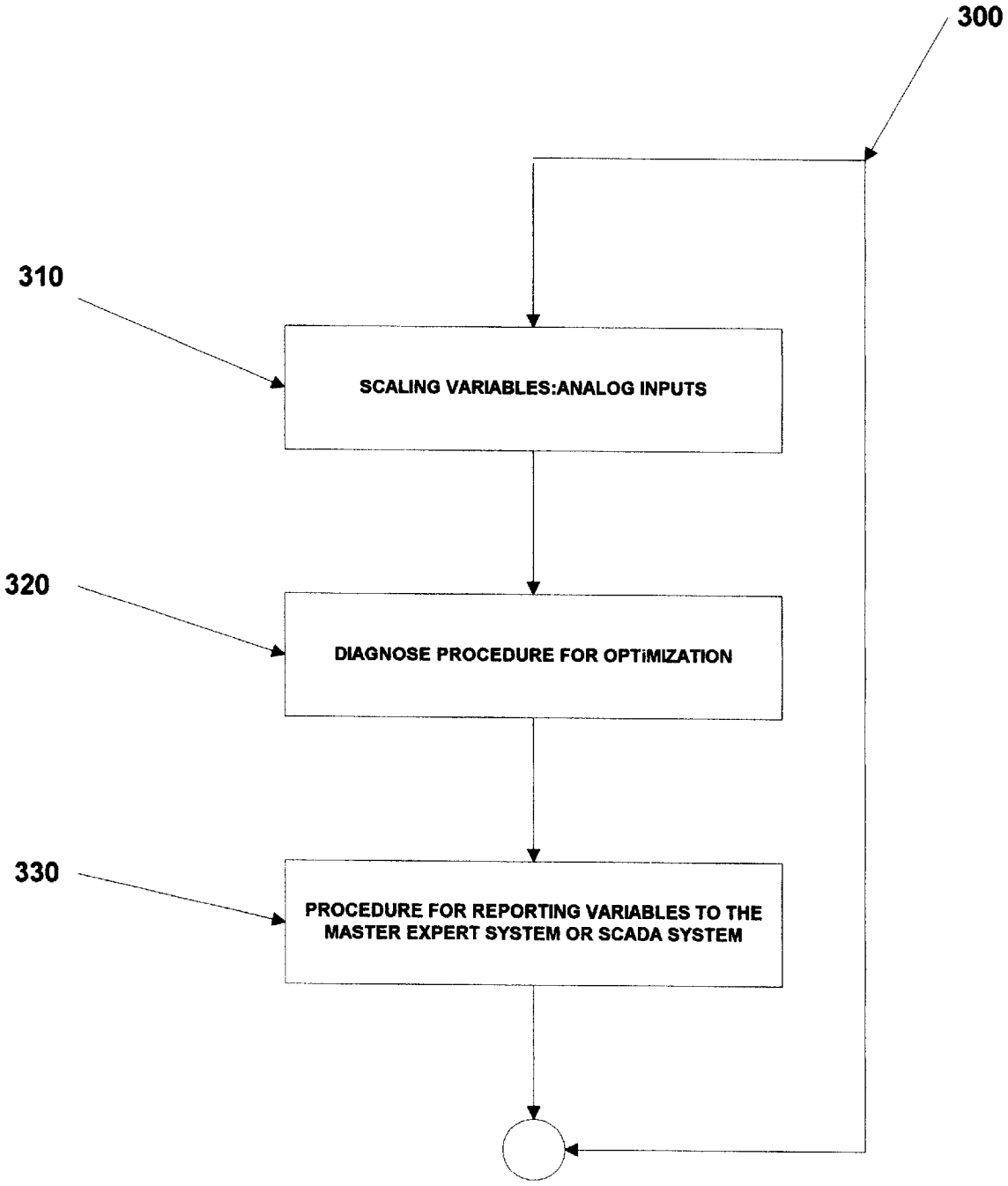
FIG. 5 depicts a block diagram of the PLC General Loop of the present invention.
Figure 6:
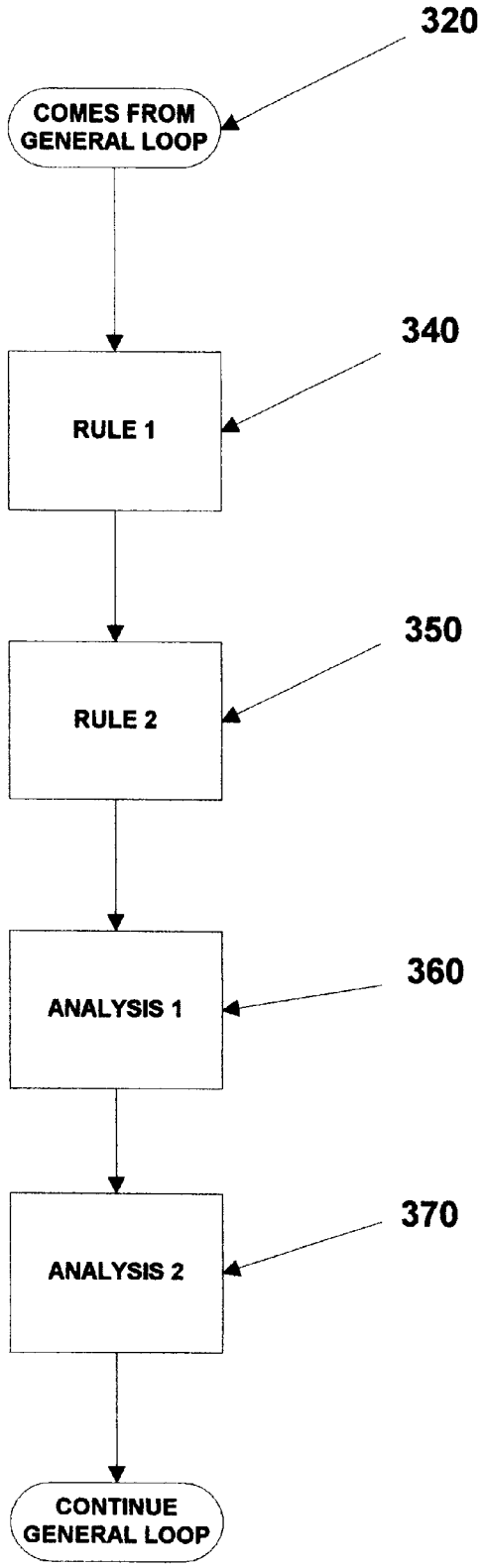
FIG. 6 depicts a block diagram of the diagnose procedure of the present invention.

The expert system ("Master" computer system) aspect of the present invention performs real-time analyses heretofore unknown in the art (see FIGS. 5 and 6). Relative to axial load, down hole pump performance is diagnosed. It is now feasible to measure or calculate the pump slippage during operation, and then to compare this slippage with either an empirical value or with a theoretically calculated value to decide whether or not the pump is worn out. As will be appreciated by those skilled in the art, predictive and preventative maintenance may be significantly improved. The present invention enables the whole pump system to be protected from operating under extreme conditions such as over-torque, overload, and under-load. In addition, system failures such as parted rods, flow-line leaks, obstructions, or stator-swell are readily detected. It is also feasible to monitor fluid level or flow rate targets. By calculating and monitoring real-time pump intake and discharge pressures, and measuring fluid gradients and fluid levels, the pump speed may be automatically adjusted to track a particular fluid level or a correlated flow rate. It is within the teachings of the present invention that such calculations may be made either by the expert system or may be selected by the user.

As will be understood by those skilled in the art, pump rotor RPM is a crucial control variable for the system contemplated by the present invention. A means of adjusting RPMs is necessary to control the production rate and fluid level of the oil or gas well. It is, of course, important that the control method implemented complies with prevalent standard instrumentation communication protocols, e.g., Modbus RTU, Modbus +, TCP/IP, 4–20 mA, eta). Some of these devices are the variable speed drive, servomotor pulley system, etc., or servomotor pulley system commonly used in the art, i.e., mechanical variable speed control device wherein servomotor adjusts the speed output of variable pitch pulleys. Thus, the expert system disclosed changes the pump speed appropriately to optimize pump operating conditions. Then, the system waits for the well to recover, depending on the well completion dimensions, flow rates, etc. During this recovery period, the instrument system does not provide any dynamic calculated information because the well is unstable and therefore, any calculations would be inaccurate. Nevertheless, the present invention continues to provide the measured information, and the basic control rules continue to operate the system.

The expert system taught by the present invention provides control rules that suggest potential pump failure, well condition, and provides alarms and even shutdowns to prevent damage to expensive pump system components. It also provides explanatory messages and concomitant information to well operators, explaining well productivity and pump performance preferably in real-time. As will be hereinafter described in detail, the expert system contemplated hereunder preferably uses fuzzy logic to generate a unique set of operating parameters for each oilfield application, and collects and analyzes historical data into a knowledge base for enabling long term decisions about pump and well performance to be conveniently made. The present invention also exploits self-generated parameters to provide practitioners in the art a dynamic knowledge base having a library of pump and well performance data which is continuously updated. Thus, the expert system taught by the present invention affords practitioners a novel synergy wherein an already comprehensive analysis may be inherently improved because all prior analysis and recommendations are incorporated therein for subsequent likewise analysis and recommendations.

As will be hereinafter described, this analysis and recommendation capability of the present invention may be interfaced with or transferred to other well applications, thereby enabling maximum optimization to be achieved in minimal time. Once the expert system of the present invention establishes rule sets from a knowledge base, then these rules may be applied to other wells. The expert system may be configured to interface with any current industry standard automation scheme. As will be appreciated by those skilled in the art, extensive data entry and analysis are provided for use assessing oil well equipment performance and the like. It will also be appreciated that embodiments of the present invention have been developed to analyze analog system values for several components integral to the electromechanical surface drive system dedicated for progressive cavity pumps. As will be hereinafter described in detail, mechanical relationships for these analog values are developed into suitable mathematical algorithms used to generate useful values for dynamic pumping conditions. The computer system taught by the present invention processes and records these values, wherein the analysis is in real-time. It is an advantageous feature of the present invention that well adjustments are made continuously. The preferred embodiment of the present invention presents these values and analyses in a user friendly human computer interface, programmed in Visual C++ for use under the Microsoft Windows environment. Thus, it will become evident to those conversant in the art, that the technology for finding these analog values, methods of analysis, and computer system designs are heretofore unknown to progressive cavity pump drive systems and the like used in oilfield production and recovery operations. That is, practitioners in the art have used downhole pressure transducers connected to a surface processor or connected to dedicated sonic apparatus for ascertaining real-time fluid level information. However, such conventional systems are not only comparatively expensive, but also afford limited capabilities because merely a single variable indicative of fluid level may be analyzed; such systems inherently lack the ability to accurately diagnose dynamic pump conditions and to provide an expert system for optimizing pump performance as contemplated hereunder.

Referring to FIG. 5, there is depicted General Loop 300 of the present invention which functions as an automatic control dosed loop for the PLC. As will be hereinafter described in detail, the General Loop 300 comprises steps of scanning variables comprising analog inputs and parameters 310, then diagnose procedures 320 for optimization as contemplated hereunder, and a procedure for reporting variables 330 to the Master Expert System or SCADA System. Now referring to FIG. 6, there is seen the steps comprising diagnose procedure 320. More particularly, certain rules are observed, i.e., Rule 1 (340) and Rule 2 (350), and certain analyses are performed, i.e., Analysis 1 (360), and Analysis 2 (370), are successively executed as will be hereinafter described to comprehensively and dynamic assess pump operating condition and performance.

Exploiting the logic and various functions of the expert system incorporated by the present invention requires that a methodology be implemented that is contrary to what has been heretofore performed by operators in the art. It will be appreciated that the underlying concepts and logic are premised on a principle ascertained from extensive laboratory and field testing: a functional relationship between axial load and fluid level has been found to be behaviorally accurate and consistent when properly adjusted for the cumulative effects of all the variables that impact this functional relationship. Indicative of the efficacy of the computer system taught by the present invention, the relationship, as developed by the instrument expert system, can be and has been expressed as a simpler equation than might normally be anticipated by those skilled in the art.

Procedurally, a series of steps is prerequisite to properly initializing a particular oilfield application. During the calibration of such an application, initial fluid levels are obtained from sonic level testing or other methods known in the art. As will be understood by those skilled in the art, at this time the fluid level and axial loads become known values. Then, several fluid level tests at different fluid levels are made to properly characterize the functional relationship between axial load and fluid level. The expert system of the present invention then generates a polynomial equation to represent this fundamental relationship. It has been found that the appropriate formula may be effectively ascertained through conventional linear regression. Of course, it may be advantageous to calculate the impact on the axial load and fluid level relationship by other variables with polynomial equations generated during this calibration step. It is a feature and advantage of the present invention that the capacity of the instant computer system to use these self-generated polynomials and actual calculated values for fluid level improves the reliability of the fluid level values, per se.

The present invention has accomplished this daunting multifarious task of real-time data collection and concomitant processing and analysis, and consequent adjustments to pump operation in a manner heretofore unknown in the art. As will be understood by those skilled in the art, the present invention exploits the ability to obtain suction pressure from the axial load supported by the drive head. More particularly, the total fluid level derived from axial loads supported by the bearing disposed in the drive head may be represented by the following expression:

$$LVL_s = \frac{W_r + R_p + (P_{wh} + P_s + (L_r G_s))(A_R - A_r) - P_c A_R - L_a}{A_R G_S} \quad (1)$$

where:

$LVL_s$=Fluid Level—ft. (Calculated)

$L_a$=Axial Load—lbs. (Measured at the load cell)

$W_r$=Weight of Rods in Fluid—lbs (Calculated)

$R_p$=Rotor Pull down—lbs. (calculated)

$P_{wh}$=Wellhead Pressure—psi (measured)

$P_s$=Friction Pressure—psi (calculated)

$L_r$=Length of Rods—ft. (measured)

$G_s$=Fluid Gradient—psi/ft. (calculated)

$A_R$=Pump Rotor Area Cross section—in$^2$ (measured)

$A_r$=Rod Area Cross section—in$^2$ (measured)

$P_c$Casing Pressure—psi (measured)

It has been found that knowledge of an operating well's dynamic fluid level provides invaluable insight into pump performance. Indeed, dynamic fluid level enables the relationship between pumping rate and well productivity to be observed in real-time, wherein pump performance may be monitored and maximized to engender not only optimal oil or gas production, but also well completion and a comprehensive knowledge of reservoir condition. It will also be appreciated that the fluid level value, as compared against the pump's theoretical output capacity, additionally suggests the condition and performance of the pump system. As with any pump, as a downhole pump wears out, operational efficiency deteriorates. In conventional downhole pumping operations, pump output is manually adjusted by appropriately varying the pump RPM in order to strive to maintain maximum well productivity. It should be evident to those skilled in the art, that with no real-time knowledge of well conditions, analysis of well and pump performance is a time-intensive and elusive effort. From a practical vantage point, without having the benefit of automated real-time analysis as contemplated under the present invention, catastrophic reduction in well production is the only realistic way in which the practitioner may see change requirements for pump production.

Generally, a well operator must use a periodic expensive and inconvenient sonic fluid level test to obtain the dynamic fluid level. However, due to the inconvenience and expense of these tests, the well operator usually estimates the required production rate in an attempt to provide maximum well productivity. Additionally, there is a serious potential of excessively low fluid levels damaging an oil well's productivity. This known potentially disastrous consequence understandably causes conservative action by an operator, thus reducing the probable maximum production of any particular oil well. Similarly, as is well known in the art, pumps are used in gas wells to relieve back pressure on the formation by removing fluid from the well bore. The back pressure produced by the fluid in the well reduces or stops the production of gas. Downhole pumps are usually placed below the well perforations to reduce the fluid level until the gas flows out of the well. Typically, the well will continue to flow until back pressure recurs due to the continuing inflow of water into the well.

Accordingly, under the present invention, suitable design parameters must be established in order to properly configure the various components of the integrated computer system so that real time pump performance may be monitored and pump optimization achieved under the influence of an automated expert system. The optimization aspect of the present invention has broken down into two primary control units. Thus, the preferred embodiment is configured using a primary control system comprising the ACU. It will be appreciated that the primary function of the ACU is to provide a detailed evaluation of well operations, containment of the expert system, and evaluation of the stored data obtained from a local controller placed locally at the well site, i.e., obtained from a PLC or from a RTU. The PLC/RCU thus provides local control of the expert system taught hereunder via access to a plurality of variables that are dictated either by downloading a corresponding plurality of values from the ACU or by values programmed that are manually programmed during system assembly and installation.

These two control units taught by the present invention require different design parameters. The ACU, functioning as the "brain" of the system, interactively interfaces with the practitioner/user and requires significant computer programming. As will be hereinafter described, a plurality of objects comprise the computerized optimization system, and either perform a particular function or are a prerequisite for recursive human interaction. Unlike the ACU, the PLC/RTU contemplated hereunder, generally requires simpler programming. Indeed, the RTU is programmed during assembly using and during operation using downloaded values from the ACU.

It will be appreciated that, in the preferred embodiment, the software implementing the ACU requires substantial user input because of the naturally required elements associated with well sites and in order to achieve the elaborate and robust pump monitoring and performance contemplated by the present invention. This plurality of input variables (and associated resulting calculations) and interrelationships, establish the functional basis for the underlying computer program modules and concomitant objects as will be hereinafter described in detail. The following enumeration of elements correspond to both user-required inputs and calculated values. It will be understood that many of the user inputs are preprogrammed in the software as a user interface for data entry.

For instance, such preprogramming of user inputs would occur if variables are known to be standard and acceptable in the industry. Contrariwise, other prerequisite variables mandate end-user input to provide design details necessary for implementing all of the capabilities contemplated in the automated system hereunder. Of course, it should be clear that the following elements only represent the basic object definitions and means for entry into the computer programs implementing the preferred embodiment. In many practical applications, polynomial linear regressions are used in the software to establish accurate values derived from proven field tests, and are indicated with their elements. Utilization of these prerequisite elements is illustrated by pseudo-code hereinafter described. Furthermore, integration of these elements and objects, and related calculations may also be readily seen in this pseudo-code. For convenience, the following elements enumerated without concomitant comment generally refer to user or programmer entries; elements are categorized within their intended objects contemplated by the preferred embodiment which is implemented in the C++ language. It will, of course, be understood that implementation may be achieved in any suitable programming language on any sufficiently powerful and versatile desktop or portable computers.

The ACU design objects comprise well object, pump object, rod object, well-completion object, drive head object, gas anchor object, surface motor object, reservoir object, communications library object, tubing object, casing object, flow line object, gas separator object, load cell object, protocol object, surface equation object, variable frequency controller object, downhole equipment object, pump optimization system object, drive head object, automation surface equipment object, coupling object, section rods object, continuous rods object.

Well objects elements and behavior are broken down as follows:

well id name static fluid level: calculated via the static pressure:

static bottom hole pressure: calculated via the static fluid level pressure of well flowing: calculated via the formula pwf=(perf depth*specific gravity oil*water gradient)+well head pressure actual producing rate: calculated via the pump operating rate; formula to be described hereinafter desired rate:

maximum rate: calculated using the standard Vogel & Darcy equations, well known in the petroleum industry, for evaluating inflow performance. If the productivity index, pi=0:

If bubble point pressure>static pressure→Vogel

Else standing (Vogel or Darcy)

Else via the productivity index and static pressure (line equation since pi curve is a straight line)

bottom hole temperature well head temperature productivity index:

bubble point pressure well head pressure: Measured on real time operation calculated via correlations from the gas separator.

gas oil ratio: calculated to compensate on real time operation wor (water cut or water oil ratio)

oil API gravity gas specific gravity water salinity $H_2S$ cut bottom hole viscosity well head viscosity aromatics percentage sand presence maximum operating speed minimum operating speed dynamic fluid level: calculated via the load cell measurement on real time operation $$Fl = \frac{\text{load cell measurement} - \text{buoyancy factor} * \text{rods weight (air)}}{\text{pump constant} * \text{pump area} * \text{fluid gradient}} - \frac{whp + fl}{\text{fluid gradient}} \quad (2)$$

calculated with the pump intake or discharge pressures and the DeltaP.

well load operational pressure: measured by the gauge in the load cell multiplied by the pumping area results the DeltaP of the pump friction losses on tubing: calculated by:

$$A = pow((0.0292*q0), 1.85); \quad (3)$$

$$B = pow(d, 4.8655); \quad (4)$$

$$Tf = 0.18*(\text{length of tubing or pump depth}/100.0)*(a/b); \quad (5)$$

fluid gradient: calculated via a linear regression of practical empirical curve upon start-up volumetric factor: calculated via correlation radius of the well draining horizontal radius buoyancy factor: determined on start-up procedure via a linear regression formation volumetric factor casing: see casing definition PCP pump object elements and behavior are broken down as follows:

brand:

model:

maximum rate @0 head @500 rpm maximum head:

maximum rate @ max. Head @500 rpm rotor diameter eccentricity hp @0 head@500 rpm hp @ max head @500 rpm number of stages operating delta pressure: calculated via the load cell measurement $$\text{Delta}P = \frac{\text{Load} - \text{Buoyancy Factor} * \text{Weight of Rods}}{\text{Constant of Pump} * \text{Pumping Area}} \quad (6)$$

pump intake pressure: calculated via correlations based on the calculated fluid level, i.e., based upon underlying design process calculated via correlation based on the DeltaP, and the well head pressure pump setting depth:

minimum submersion of pump operating RPMs: calculated via a parametric function depending on the operating DeltaP, and upon the desired or actual rate:

$$vb = q\max 5/500; \quad (7)$$

$$aa = (q\max 5 - qap\max 5)/pow(p\max,2); \quad (8)$$

$$Rrpm = ((q\max\ poz + aa * pow((2.308 * \text{DeltaP}),2))/vb); \quad (9)$$

operating rate: calculated via delta pressure of pump and operating rpm; tested by measuring the presence of fluid elastomer: determined by conditions of the well, e.g., aromatics, sand, etc.

k constant for pumping area minimum starting-up torque

Rods object elements and behavior are broken down as follows:

friction losses on rods: calculated via the correlation diameter roughness factor linear weight density weight on air Completion object elements and behavior are broken down as follows:

perforation depth total vertical depth casing tubing rods flow lines true vertical depth of every piece Drive head object elements and behavior are broken down as follows:

brand model: recommended by the computer program via the maximum axial load to be generated by the system maximum axial load maximum hp minimum rpm maximum rpm Gas anchor object elements and behavior are broken down as follows:

efficiency

Surface motor object elements and behavior are broken down as follows:

brand model size: calculated by the computer program via the maximum hp to be managed by the drive head maximum hp maximum temperature maximum current actual temperature: measured via a temperature transmitter actual current under operation: measured via an amp meter in one of the phases of the motor balance condition: calculated via the value of the current in every phase Reservoir object elements and behavior are broken down as follows:

name field geographical address reservoir thickness vertical permeability constant horizontal permeability constant number of wells wells Communications Lib. object elements and behavior are broken down as follows:

protocol hardware platform (layers of the operating system model, serial port, Network port)

configuration

Tubing object elements and behavior are broken down as follows:

number of sections internal diameter outside diameter roughness factor weight linear density length of the section Casing object elements and behavior are broken down as follows:

number of sections internal diameter roughness factor weight linear density length of the section Flow line object elements and behavior are broken down as follows:

length internal diameter pressure drop-down: calculated by the program via the gas separator pressure and the well head pressure calculated having one of the above and using the correlations.

roughness factor average angle from the horizontal (up "+", down "−") with the vertices on the well head Gas separator object elements and behavior are broken down as follows:

volume capacity separation pressure temperature actual pressure: measured via a pressure transmitter Load cell object elements and behavior are broken down as follows:

total area to load pressure of hydraulic fluid: measured by the pressure transmitter on the load cell total axial load: calculated via the pressure of the hydraulic fluid multiplied by the total area to load maximum axial load measurable: calculated via an analysis on the load cell Protocol object elements and behavior are broken down as follows:

communications configuration frame error messages error checking function codes

Surface eq. object elements and behavior are broken down as follows:

motor variable frequency controller

Variable frequency controller object elements and behavior are broken down as follows:

input voltage output voltage frequency range frequency step

Downhole equipment object elements and behavior are broken down as follows:

pump gas anchor

PCP Optimization System object elements and behavior are broken down as follows:

well automation surface equipment downhole equipment

PCP well model

Drive Head object elements and behavior are broken down as follows:

it is a drive head but has load cell

Automation surface equipment object elements and behavior are broken down as follows:

variable frequency controller alm drive head

Coupling object elements and behavior are broken down as follows:

external diameter length friction losses on couplings: calculated via a correlation Section rods object elements and behavior are broken down as follows:

friction losses on rods: calculated via the correlation number of sections diameter length of section roughness factor linear weight density weight on air couplings Continuous rods object elements and behavior are broken down as follows:

friction losses on rods: calculated via the correlation diameter length of section roughness factor linear weight density weight on air Classes relationships for a reservoir are broken down as follows:

a reservoir has wells

Classes relationships for a well are broken down as follows:

a well has an artificial lift equipment; a well has surface equipment and downhole equipment a well has a completion; a well has casing tubing rods, couplings Classes relationships for artificial lift equipment are broken down as follows:

an A.I.M. (Drive Head with load cell) has surface equipment an A.I.M. has downhole equipment Classes relationships for downhole equipments are broken down as follows:

it has a pump it has a gas anchor

Classes relationships for surface equipment are broken down as follows:

it has a motor it has a variable frequency controller it has a head

Classes relationships for completion are broken down as follows:

has a casing has a tubing has rods has couplings has a flow line

Classes relationships for PCP artificial lift equipment are broken down as follows:

it is a kind of an a.l.equipment.

it has a PCP pump as downhole equipment it has a drive head as surface equipment Classes relationships for pump are broken down as follows:

has maximum rate has a maximum head has speed

Classes relationships for PCP pump are broken down as follows:

it is a kind of a pump it has a rotor it has stator

Classes relationships for gas anchor are broken down as follows:

it has an efficiency

Classes relationships for an axial load measurement drive head are broken down as follows:

it is a kind of a drive head it has a load cell

Classes relationships for a PCP well model are broken down as follows:

it has basic rules it has expert rules

Classes relationships for an optimization PCP system are broken down as follows:

it has a well it has automation surface equipment it has downhole equipment it has a completion it has a PCP well model Classes relationships for an automation surface equipment broken down as follows:

it is a kind of a surface equipment but it has a variable frequency controller it has an alm drive head Referring again to FIG. 4, PLC/RTU 400 receives four analog inputs through field instrument marshall 10. More particularly, field instrument marshall 10 receives analog input from each of flowline pressure transducer 15, casing pressure transducer 20, motor temperature transducer 30, and RPMs provided by variable frequency controller 60, inverter, or a RPM magnetic pickup. It will be understood that, when using a variable frequency controller or an inverter, the variable is contemplated to be provided by the Modbus serial port. It will be appreciated that all of the analog inputs should preferably be 4–20 mA inputs. Thus, under the present invention, the RTU will simultaneously process pressure information transmitted from each of the load cell and well head, motor current and temperature information, and RPM information.

The plurality of variables incorporated into the rules and formulas and algorithms taught by the present invention and implemented into the preferred embodiment are enumerated as follows:

WHPH: High Range Value for the Well Head Pressure.
WHPL: Low Range Value for the Well Head Pressure.
LCPH: High Range Value for the Load Cell Pressure.
LCPL: Low Range Value for the Load Cell Pressure.
CALC1: System Axial Load
CALC2: Operating DeltaP
CALC3: Weight of Rods
CALC4: BOUYANCY FACTOR
CALC5: Operating Fluid Level
CALC6: Nominal Load
CALC7: New RPMs.
K1: Weight of Rod String on Air
K2: Friction Losses
K3: FLUID GRADIENT
K4: PUMP Area.
K5: The Optimum Dynamic Fluid Level.
K6: Optimum Well Head Pressure
K7: Optimum RPM.
K8: Maximum RPMs.
K9: Minimum RPMs.
K10: Pump DeltaP Desired
K11: Qmax5
K12: Qpmax5
K13: Maximum Head the Pump is capable of managing.
K14: Load Cell Area in Square inches.
K15: Maximum Rate at which the well can produce
K16: Step for incrementing or decrementing the RPMs
K17: Recovery Time for the well to expect the load to resume to its normal band
K18: Nominal Current for the Motor or VFC, etc.

As will be hereinafter described in detail, these variables are subsumed into a plurality of rules, analyses and procedures that perform the advantageous pump optimization disclosed in the present invention. The convention used herein for identifying these rules, analyses, and procedures are enumerated as follows:

Rule 1: Parted Rods Detection
Rule2: Current Detection
Analysis1: Load Analysis
Analysis2: Well Head Pressure Analysis
Procedure 1: Pump Slippage Calculation Procedure
Procedure2: Current Detection.
ARRAY 1: Array containing the Load measurement during the pump slippage procedure According to the preferred embodiment, new RPMs are recommended and set by the computerized expert system. This may also be provided via the Modbus port to a slave variable frequency controller ("VFC"), etc. As hereinbefore described, the standard of 4 to 20 mA should preferably be supported. The system will have four digital outputs for triggering automatic shutdown of the pumping assembly. It will be appreciated that normally the PLC manufacturer provides a minimum amount of digital outputs. It is, of course, contemplated by the present invention that there should be four such output in order to have sufficient room for three optional digital outputs that might be needed. Similarly, three digital inputs should preferably be provided corresponding to a "No Operation" condition, a "Motor Overheat" alarm, and a "Current or Power Supply" failure alarm. It should be understood that a memory area should preferably be reserved for the constants to be used in this process. Most of these variables are determined during the start-up procedure and may be downloaded or overridden by the Master upon operation.

According to the present invention, regarding scale considerations, calculations are performed on the current measurement registered by the PLC (as an analog input) via the formula:

$$\text{Actual Value} = \frac{\text{Current Measurement (mA)}}{16} * (HRV - LRV) + 1.25 * LRV - 0.25 * HRV \tag{10}$$

wherein Current Measurement is the analog input value; HRV is high range value; LRV is low range value. HRV and LRV are constants of the PLC and can be set by the Master Expert System of the present invention and then be downloaded to the PLC.

System Axial or Thrust Load ("AI") is to be calculated via the formula:

$$\text{Load=LC_Pressure*LC_AREA} \tag{11}$$

or $$\text{Load=Strain Gauge output}$$

wherein LC_Pressure is the pressure registered by a pressure transmitter (4–20 mA) used with a hydraulic load cell; LC AREA is a constant determined by the operator of the PLC. This load value initially equals 31.42 square inches. Changes to this parameter should preferably be set by downloading another configuration from the Master Expert System by writing on certain Modbus address. Under the preferred embodiment, the system load value is reported to the Master via the Modbus port.

The Pump DeltaP is determined from the formula:

$$\text{DP=(System_Load−Weight_of_Rods)/PUMP_Area} \tag{12}$$

wherein DP is Pump DeltaP; System_Load is calculated as hereinbefore described;

Weight_of_Rods=Weight_of_Rod_String_on_Air*Bouyancy_Factor; (13)

and PUMP_Area is a constant that is downloaded by the Master Expert System. It will be appreciated by those skilled in the art that Bouyancy_Factor is typically determined by the startup-up procedure as a function of RPM. Thus, in order to know the buoyancy factor, it is necessary to measure the RPM. It will be understood that there is a memory map stored in the PLC for holding arrays with corresponding values for both RPM and buoyancy factors. A representative memory map generated by the PLC of the preferred embodiment is:

| RPM | Buoyancy Factor |
|---|---|
| 0 | 0.47 |
| 100 | 0.43 |
| 200 | 0.40 |
| 300 | 0.35 |

If the RPM value is in between values stored in two successive rows of this array, then a linear extrapolation is necessary to ascertain the buoyancy factor value. For example, if the RPM in a certain moment is 150, then the Buoyancy Factor is obtained via the formula:

$$BF = 0.43 + \frac{(0.40 - 0.43)}{(200 - 100)} * (RPMS - 100) \quad (14)$$

Then, the BF=0.415. Under the present invention, this value is reported to the MASTER via the Modbus port.

Under the present invention, fluid level is calculated from the following formula:

$$\text{Fluid Level} = \frac{(\text{Pump Delta}P - \text{Well Head Pressure} - \text{Friction Losses})}{\text{Fluid Gradient}} \quad (15)$$

wherein: Pump_DeltaP: is calculated as heinbefore described; Well_Head_Pressure is an analog input; Fluid Gradient is a constant to be set upon start-up by the Master; Friction Losses is a constant determined by the Master on the start-up, and may be settable during operation. It will be appreciated that the underlying design of the expert system taught by the present invention is based on some theoretical values generated from formula (1) described hereinbefore. It has been discovered that the present system may use a polynomial regression formula to provide accurate fluid level values. The boundary values for generating this polynomial regression formula is established during the start-up sequence in the field. During start-up, the fluid level is actually measured preferably using sonic equipment. The computer system taught by the present invention evaluates axial load, flow line pressure, casing pressure, and known variables against sonic fluid level values to generate an appropriate regression formula. The result of this generated formula is compared against theoretical values derived from the original formula. This error checking is used to provide accurate fluid level values and relationships regarding other variables. Once the polynomial formula is thus established, accurate low-level values are provided to the Expert System and, subsequently, to the user in the field.

It should be dearly understood that this model for pump design and optimization is generated on an individual basis for each well site. It should also be understood that this plurality of formulas and mathematical functions are programmed both in the ACU and the PLC/RTU. To provide accurate fluid level and concomitant information during the life span of pumping systems contemplated hereunder, re calibration should be preferably performed periodically using sonic fluid level measuring devices.

Under the teachings of the present invention, nominal load constitutes a reference value for the system load and is used when the basic rules are being executed on the PLC.

Nominal Load=Pump Area*(Flo*Fluid Gradient+WHPo+Friction Losses)+Weight of Rods (16)

wherein: PUMP_Area is hereinbefore described; FLo is optimum fluid level, which is a constant determined by the Master on start-up and settable under normal operation; Fluid_Gradient is hereinbefore described; WHPo is optimum well head pressure considered to be normal under operation, which constitutes a constant to be determined by the Master on start-up and can be changed during operation; Friction_Losses is hereinbefore described; Weight_of_Rods is hereinbefore described and corresponds to the buoyancy factor calculated using the value of RPMo to correlate; and RPMo is the optimum RPM, which is a design constant set by the Master on start up and settable during operation by the Master.

Relative to the System RPM parameter, there are two constants to be set upon start-up, and settable during operation: MAX_RPM and MIN_RPM. As will be understood by those skilled in the art, MAX_RPM specifies the maximum RPMs allowable for the pumping system and MIN_RPM specifies the minimum RPMs for operation. It will be appreciated that the minimum RPM during normal pump operation is zero.

The formula for the RPMs is $$RPM = 500 * \frac{Qmax + A * (2.308 * DP)^2}{Qmax5} \quad (17)$$

wherein: Qmax is the maximum rate possible for the pump system, or is another value settable by the Master, and remains constant under normal operation; DP corresponds to Pump_DeltaP_Desired which is the value for the DeltaP that the rules of the present invention are recommending to be set next—this value can be determined either by a rule or by the Master Expert System; Qmax5 is the maximum rate the pump is capable of managing when operating at 500 RPM @ zero head, and is a constant determined by the Master on start-up; A is a factor determined by the formula:

$$A = \frac{(Qmax5 - Mpmax5)}{Pmax^2} \quad (18)$$

wherein: Qpmax5 is the maximum rate that the pump is capable of managingwhen operating at 500 RPM @ maximum head, and is a constant determined by the Master on start-up; Pmax is the maximum head of the pump, which is a constant determined by the Master on start-up. The value of the RPMs under the preferred embodiment is contemplated to be set by the Modbus port as a new frequency value. It will be appreciated by those skilled in the art that, for every VFC, the new frequency is determined by formula as a function of the requested RPM; optionally it will be an analog 4–20 mA output. In both cases the set-point may vary depending on the way the Slave device for adjusting RPMs understands the command, whether it is a new set-point, or a certain increase or decrease of the current value. If there is an increase or decrease of this current value, it is necessary to know the current RPMs in order to know the differential value thereof.

The application of this plurality of objects and variables may be conveniently illustrated using pseudo-code. For example, in Analysis 1, the load analysis aspect of the present invention considers every value for the load between the Hi-Normal-Limit=0.85*Nominal_Load and The Lo-Normal Limit=1.15*Nominal_Value to be considered normal. Hence, for loads within this comfort zone there is no alarm generated by the present invention. For events which occur outside of this zone, however, alarms are triggered: (Nominal_Value corresponds to CALC6)

```
Events: Hi-Normal-Limit Exceeded:
    count1 = count1 + 1
    if count1 >3 Shut_Down and Reset count Generate Alarm and
                Exit Loop
    else    Decrease RPMs    (Decrease A01)
            Wait for Recovery Time
Lo-Normal-Limit:
    count2 = count2 + 1
    if count2 >3 SHUT_DOWN and Reset count Generate Alarm and
                        Exit Loop
    else    Increase RPMs    (Increase A01)
            Wait for Recovery Time
Continue General PLC Loop
```

It should be noted that, within this loop, the increment of RPMs is a constant to be set by the Master upon start-up, and can be changed during normal operation. The Recovery Time contemplated under the present invention is a period of time during which the load will be measured, but during which the event loop is not going to be executed again. It should be evident that this procedure is observed in order to enable the pump system to recover from the new RPMs set-point. Once the Recovery Time has expired, of course, the event loop will be executed again if another Limit Violation occurred, even though the normal scan for the PLC is not interrupted by such an event.

For normal operation, start-up of the computer system taught by the present invention is first configured by setting the values for every constant or parameter required by the PLC to perform the logic contained in the General Loop (see FIG. 5). These values include HRV, LRV, and Weight_of_Rod_String_on_Air which are enumerated in the following:

HRV: High Range Value for the analog inputs. For the Load, the HRV is given by the formula:

$$\text{HRV}=1.5*(\text{Rods Weight in Air}*\text{Buoyancy Factor @ 0 RPM}+(\text{Pump_Setting_Depth}*\text{Fluid_Gradient}*\text{Pump_Area})) \quad (19)$$

LRV: Low Range Value for the analog inputs. For the Load, the LRV is given by the formula:

$$\text{LRV}=(\text{Weight_on_air_of_Drive_Head_Shaft}) \quad (20)$$

Weight_of_Rod_String_on_Air: free weight of the whole rod string

It should be noted that the HRV and the LRV for the well head pressure transmitter are settable by the Master during this start-up procedure. It is contemplated that a memory area for downloading all such constants will be established in the PLC.

According to the prevent invention, a memory map should also be generated upon start-up to determine the buoyancy factor depending upon the RPMs. This determination is assisted by an Echometer or a Sonolog system in order to approximate the Fluid Level. It has been found to be advantageous to conduct several tests from 0 RPM to 500 RPM to arrive at a suitable Buoyancy Factor calculation:

$$BF_x = \frac{(LC - \text{Pump Area} * (FL + \text{Well_Head_Pressure} + \text{Friction Losses}))}{\text{Weight_on_Air_of_Rods}} * XRPM \quad (21)$$

wherein: BFx is the Buoyancy Factor @ the RPM X; FL is the fluid level registered by the Echometer or Sonolog; and the rest of the variables are already designed. Then, a memory map should be established in the PLC, so that the Buoyancy Factor may be determined whenever it is necessary for the pump performance and optimization contemplated hereunder.

Another variable is the fluid gradient which is a constant to be determined during the well sizing or design phase. Based upon an operator's practical experience, the Fluid Gradient should generally considered to be constant. Nevertheless, the variations on the axial load due to compressed free gas in the tubing fluid column should not be very high because of the low weight of the free gas. Experimentations in field have generally supported this theory. PUMP_Area is a variable that corresponds to pumping area considering the effect of the rods. FLo is the value of the optimum dynamic Fluid Level which is preferably determined by knowing the value of the desired rate. Then, by using the pump performance curve shown in FIG. 12 and with the values of the desired RPMs, the head across the pump, i.e., the DeltaP of the pump, is calculated. Once the Pump DeltaP is calculated, the optimum dynamic Fluid Level may be ascertained:

$$FLo = \frac{\text{Delta}P - \text{Well_Head_Pressure} - \text{Friction_Losses}}{\text{Fluid_Gradient}}$$

$$Flo = \frac{\text{Delta}P - \text{Well_Head_Pressure} - \text{Friction Losses}}{\text{Fluid_Gradient}} \quad (22)$$

Similarly, WHPo is the optimum well head pressure considered to be normal under operation. This pressure is typically determined by the Gas Separator and then correlating pressure to the well head. If the well is an old well, then WHPo might be set by the operator. RPMo is the optimum RPM which is determined from knowledge of the optimum FLo or the optimum DeltaP:

$$RPM = 500 * \frac{Qmax + A * (2.308 * DP)^2}{Qmax5} \quad (23)$$

MAX_RPM is the maximum RPMs allowable for the pump system, whether it is limited by the VFC, the drive head, or by the well operator. MIN_RPM is the minimum RPMs allowable for the pump system. Pump_DeltaP_Desired is the DeltaP across the pump when producing the desired production rate @ the desired RPM, and is determined based upon the pump curve. While, as will be appreciated by those skilled in the art, all of the desired RPM values are ideal, such values are necessary for system start-up. Variable Qmax5 corresponds to the maximum rate that the pump is capable of managing when operating at 500 RPM @ zero head. Similarly, Qpmax5 is the maximum rate that the pump is capable of managing when operating at 500 RPM @ maximum head. Pmax is the maximum head that the pump is capable of managing.

It should, of course, be clearly understood that this start-up procedure should include the calculations of the values for each and every variable or constant described herein. These calculations are based upon the information provided by the well operator, maximum rate, API gravity, etc. A start-up related consideration is Rods Pull Down Load calculation. The Rods Pull Down Load is the load that is caused by the rod stretch when the pump starts running. While there is no known reliable way to determine the RPDL, with some practical assumptions, this value can be measured. Under the preferred embodiment, the Echometer Reading is considered to be the actual pull down load measurement. Accordingly, the calculated fluid level with the axial load will be corrected as appropriate. It has been generally found that the fluid level measured with the axial load is less than the Echometer measurement. If, in any moment the Echometer reading is EFL, and the Axial Load reading is AFL, then a correction number—the RPDL—will be determined:

$$RPDL=(EFL-AFL)*FLUID_GRADIENT*PUMP_AREA \quad (24)$$

It has been found that, to assure that pump performance is properly monitored and optimized, RPDL should be measured upon start-up and at a very low speed, e.g., less than 100 RPM, to make sure that the highest value is taken.

The Expert System herein considers fracturing of these rods via a Rods Fracture Rule. In particular, If System_Load<Weight_of_Rod_String_on_Air*BF @ 0 RPM Shut_Down and Generate Alarm and Exit Loop.

It should be understood that the buoyancy factor, BF, used in this correlation is calculated at zero RPM to assure that there is, indeed, a fracture condition. For a Pump Slippage condition, the Expert System proceeds as follows:

```
If Not Shut_Down
  Shut Down while System_Load>0.85*Nominal_
    Load or
  Time Elapsed<30 seconds
  Continue to Measure Load
  Store Load and Time Startup
  Loop
Exit Procedure
```

The following pseudo-code illustrates the Expert System's procedure for current detection:

```
Hi-Normal-Limit Exceeded:
  Shut_Down and Generate Alam and Exit Loop
  Loop
Lo-Normal-Limit:
  Shut_Down and Generate Alarm and Exit Loop
  Loop
Unbalanced Condition
  Shut_Down and Generate Alarm and Exit Loop
    _Loop
Power Supply Failure
  Shut_Down and Generate Alarm and Exit Loop
  Loop
```

Referring now to FIG. 5, there is shown control and optimization algorithms taught by the present invention. Relative to axial load, Max. Load is the load value at the point of shut down due to overload. Min. Load is the load value at the point of shut down due to underload. DV (Design Value) is the load at which the well is under normal conditions and producing at its optimum rate. Decrease RPM corresponds to the conditions under which the system will automatically decrease the pump RPMs until the load value is within the normal operation band. This normally equals 1.1*DV, wherein the customer makes the selection with recommendation by the expert system. Increase RPM corresponds to the conditions under which the system will automatically increase the pump RPMs until the load value is within the normal operation band. This normally equals DV/1.1, wherein the customer makes the selection with recommendation by the expert system. The load values are compensated due to impact of factors affecting hydraulic loads, such as flow-line pressure, casing pressure, and mechanical friction in the downhole elements. Under normal operating conditions, the axial load is to remain within its band once the system has reached the RPM at which the target fluid level occurs, and speed variations may take place according to load variations.

Maximum Axial Load corresponds to the conditions under which the pump differential pressure is high due to a low pump suction pressure, suggesting that the pump production rate is too high. RPM is decreased until the axial load goes back to normal after the recovery time. Several adjustments are attempted preferably with the number of adjustments being selected by the user. If the system fails to recover, a shutdown command is generated. Minimum Axial Load corresponds to the conditions under which the pump differential pressure is low due to a high pump suction pressure. Pump speed increments are issued to increase the axial load. If this fails, after several attempts, a shutdown is generated. If the axial load reaches a value lower than Minimum Load, referring to FIG. 5, the event of parted rods is detected, and a shutdown command is immediately generated. Well Head Pressure, Current, Temperature Analysis corresponds to the conditions under which there is a shutdown command or alarm generated when any of these variables exceed selected maximums or minimums.

It has been found that there are advantageous general tips for application of the PLC Rules described herein. First, the Increase or Decrease RPMs command of the Expert System can be overridden by a Shut-Down command, but the contrary is not possible. Second, the PLC will run the Pump Slippage Procedure upon request from the Master. Next, all of the computer system constants, analog inputs and outputs, digital inputs and outputs, and step-wise calculations (variables calculated in the PLCs formulas or Rules and procedures) must be retrievable and settable by the Master Expert System or by a SCADA system, upon operator request. Furthermore, upon detection of any of the three digital input alarms hereinbefore described, the system taught hereunder will be shutdown, and the alarm will be generated for the Master to retrieve it the next time it requests an Information Log.

Under the present invention, two WHP upstream of the choke and downstream analuysis proceeds thusly:

```
Loop
Measure all variables
If (Well_Head_Pressure_Upstream = Well_Head_Pressure_Downstream)
    Go ahead for the Regular Analysis
else
    If (Well_Head_Pressure2 IS Normal)
```

-continued

```
If (Well_Head_Pressure1 is Low and Load is Hi and
CurrentNormal)
    Free Gas across the Pump and Decrease RPM
If (Well_Head_Pressure1 is Low and Load is Hi and CurrentHi)
    Sand Across the Pump and Decrease RPM
If (Well_Head_Pressure1 is Normal or Hi and Load is Lo and
CurrentNormal)
    Well_Flowing Naturally, Shut_Down and Report
If (Well_Head_Pressure1 is Normal or Hi and Load is Hi and
CurrentNormal)
    Well is losing Fluid Level and Decrease RPMs
wherein Well_Head_Pressure1 corresponds to
WELL_HEAD_PRESSURE_DOWNSTREAM and Well_Head_Pressure2 corresponds to
WELL_HEAD_PRESSURE_UPWNSTREAM.
```

It will be understood that Recovery Time contemplated by the present invention is the time a well needs to respond and stabilize when it is undergoing a speed change. Thus, Recovery Time is defined as the time needs to displace the complete fluid column above itself to the surface flowline. Under the preferred embodiment, this time is calculated as follows:

$$\text{Recovery Time} = \frac{\text{Volume of Fluid Column (Barrels)}}{\text{Daily Rate (Barrels)}} = \frac{3.14/4(\text{Tubing ID})^2 * PSD}{\text{Daily Rate (Barrels)}} \tag{25}$$

86,400 seconds.

Other correlations incorporated into the preferred embodiment include, based upon the hereinbefore enumerated variables and parameters:

$$\text{CALC1=AI1*K14} \tag{26}$$

$$\text{CALC2=(CALC1−CALC3)/K4} \tag{27}$$

$$\text{CALC3=K1*CALC4} \tag{28}$$

For CALC4, the hereinbefore illustrated memory map will be used to determine the value for this variable. In actual practioe, the map preferably consists of two arrays of 10 values each. As will be understood by those skilled in the art, there is a corresponding relation between each member of the first and the same member of the other. Depending from the value of INPUT1, there is a different CALC4. That is, to know the value of CALC4, it is necessary to measure the INPUT1. If the value of INPUT1 is in between two of the same array, then a linear interpolation is performed to ascertain the value for CALC4. For example, If the INPUT1 at a certain moment is 150, then CALC4 is determined to be 0.43+(0.40−0.43)/(200−100)*(INPUT1−100) or 0.415.

$$\text{CALC5=(CALC2−AI2−K2)/K3} \tag{29}$$

$$\text{CALC6=K4*(K5*K3+K6+K2)+CALC3} \tag{30}$$

wherein for CALC3 in this context, the Buoyancy Factor is calculated using the value of K7 instead of INPUT1.

$$CALC7 = 500 * \frac{K15 + A * (2.308 * K10)^2}{K11} \tag{31}$$

where A corresponds to a factor determined by $$A = \frac{K11 - K12}{K13} \tag{32}$$

It will also be understood that the value of CALC7, as a new frecuency or RPM value, is to be set by the Modbus port or via an analog output (AO1). Under the present invention, there is a formula for every VFC to determine what the new frequency will be as a function of the requested RPM. Optionally, it will be an analog 4–20 mA output. In either case, however, the set-point may vary depending on the way the slave device used for adjusting RPMs comprehends the command—whether it is a new set-point or whether a certain increase or decrease of the current value. If the slave device interprets the command to change the value, it is, of course, necessary to know the current RPMs relative to what the differential value is being changed.

Calculation of the friction losses in the annular space between rod string and tubing during operation conditions implicates several parameters including Current_Rate, HoldUp, Internal Tubing Diameter, Rods External Diameter, Density of Fluid, Viscosity of Fluid, Length of Section, Pump Setting Depth. For r=0.001 corresponding to the minimum value for tubing relative rugosity, and b corresponding to External_Diameter/Internal_Diameter, i.e., the ratio between diameters, the diameters correction factor for calculating the Reynolds Number (Kb) is:

$$Kb = 1 - b^4 + \frac{(1 - b^4)^2}{\log(b)} \tag{33}$$

for which the maximum value is 1. The Reynolds Number Correction Factor (Z) is calculated as:

$$Z = (1 - b)2 * (1 - b2)/kb$$
$$Z = (1 - b)^2 * \frac{(1 - b^2)}{Kb} \tag{34}$$

The Hydraulic Diameter is calculated as:

$$Hd = \frac{|(\text{Internal Diameter}^2 - \text{External Diameter}^2)|}{(\text{Internal Diameter} + \text{External Diameter})} \tag{35}$$

then the flowing area is obtained as follows:

$$3.1416 * \frac{|(\text{Internal Diameter}^2 - \text{External Diameter}^2)|}{4} \tag{36}$$

factor Q=Current_Rate/HoldUp, and average speed in (m/s)

$$\text{Velocity} = \frac{Q}{(350.62 * \text{Flowing Area})} \tag{37}$$

wherein Effective Reynolds Number Ref is ascertained by $$406.86*\text{Velocity}*\text{Fluid Density}*\text{Hd}/(\text{Fluid Viscosity}*z) \tag{38}$$

if Ref>2000, then the condition is Turbulent Flow ff=ColeBrook_Factor (reef, rr); (Colebrook Factor)

Accordingly, Friction Losses may be established by (62.4/12)*ff*(3.281*Velocity)2*LENGTH_OF_SECTION/(2*Hd*gravity);

$$\frac{62.4}{12} * ff * (3.281 * \text{Velocity})^2 * \frac{\text{Length_of_Section}}{2 * Hd * \text{gravity}} \tag{39}$$

else, the condition is Laminar Flow and the Friction Losses may be established by $$\frac{8 * \text{Viscosity} + q + \text{Length_of_Section}}{511.8505 * 10000 * Kb * 3.1416 * \left(\frac{\text{Internal Diameter}}{4}\right)^2} \tag{40}$$

Once, Friction Losses are determined, viscosity and density may be calculated.

For the Colebrook_actor calculation, this calculation is based upon a loop that is to be generated until the following condition is achieved:

$$|df| < ftol \text{ AND } |y| < ytol$$

where ytol=0.0001 and ftol=0.000001. According to the teachings of the present invention, df and y are calculated every time the loop is executed. It has been found that the Loop is executed at most 20 times if this condition is not reached before. It will be appreciated that this procedure guarantees that a convergence value is reached for the Loop and the Colebrook Factor f. Loop Calculations are as follows:

$$y = 2 * \frac{\log\left(\frac{\text{Relative_Rugosity} + 9.28}{\text{Reynolds_Number} * \sqrt{f}}\right)}{\log(10)} + \frac{1}{\sqrt{f} - 1.14} \tag{40}$$

$$yp = \frac{-1}{(2 * f^{1.5})} - \frac{9.28}{\left(\text{Reynolds_Number} * f^{1.5} * \text{Relative_Rugosity} + \frac{9.28}{(\text{Reynolds_Number} * (f))}\right) * \log(10)} \tag{41}$$

then df=y/yp; and the new value for f is adjusted before the loop is repeated $$f = f - df.$$

If the number of times the loop has been repeated exceeds 20, the loop is exited and the Colebrook Factor is the last value of f.

Relative to the calculation of viscosity, to ascertain viscosity during operational conditions, a loop is also generated to calculate an average value between two heights, i.e., between two points of the tubing string. For instance, a Well head height (0) and Pum Setting Depth may be selected heights. Under the present invention, the Loop divides the tubing string into smaller pieces and then the Average Temperature is calculated in that piece. Next, the Average Viscosity is calculated under these conditions and the value is added to an accumulator in the end of the Loop. It will be understood that when the calculations have been made across the whole string, the Accumulator is divided by the String Length. This loop is mathematically equivalent to calculating the integral of the viscosity with respect to the height:

$$\int_{\text{Initial Depth}}^{\text{Final Depth}} \left(\frac{d\,\text{Viscosity}}{d\,h}\right) * d\,h \tag{42}$$

Thus, in this instance, the Initial Depth corresponds to the Well Head point and the Final Depth corresponds to the Pump Setting Depth.

int nn;

double h,imudh,dh,tc,t,m,mu,mu0,whdm=0,rdm=0, Initial_Temperature;

nn=10;

The differential of Height is the total length divided by 100 (100 pieces)

dh=(Final_Depth-Initial_Depth)/nn; wherein the Initial value for the differential of the viscosity is 0.

imudh=0;

According to the present invention, the initial temperature is calculated with:

$$\text{Initial_Temperature} = \text{Well_Head_Temperature} + \text{Initial_Depth} * \frac{(\text{Bottom_Hole_Temperature} - \text{Well_Head_Temperature})}{\text{Perforation_Depth}} \tag{43}$$

muw=1; Water Viscosity

Dilute Fraction in liquid r=Dilute_Fraction/(Dilute_Fraction+Oil_Fraction);

Water Fraction In liquid fagua=Water_Cut/(Water_Cut+Dilute_Fraction+Oil_Fraction);

Calculation of the viscosity of the oil with the function Visco1 with a plurality of parameters:

vc=visco1 (Oil_api, Well_Head_Temperature, Well_Head_Visoosity, Bottom_Hole_Temperature, Bottom_Hole_Viscosity, Initial_Temperature). If the dilute fraction in the tubing (Bottom Hole Dilute Injection) is different from zero, then the viscosity of it is calculated as well:

vd=visco1 (Dilute API Gravity, Well_Head_Temperature, Well_Head_Dilute_Viscosity, Bottom_Hole_Temperature, Bottom_Hole_Dilute_Viscosity, Temperature).

$$\text{Auxiliary Variable} = e^{r*(log(log(vd+0.7)))+(1-r)*(log(log(vc-0.7)))} \tag{44}$$

And the mix viscosity is determined from:

$$vm = e^{Auxiliary\ Variable} - 0.7 \tag{45}$$

The density of the mixture is:

$$\text{Dilute Density} = 0.000343*(60-\text{Current_Temperature}) + \frac{141.5}{(131.5+\text{Dilute API})} \quad (46)$$

$$\text{Oil Density} = 0.000343*(60-\text{Current_Temperature}) + \frac{141.5}{(131.5+\text{Oil API})} \quad (47)$$

$$dm=r*\text{Dilute_Density}+(1-r)*\text{Oil_Density} \quad (48)$$

Accordingly, the Mix Viscosity is obtained:

$$\text{Mix Viscosity}=vm*dm \quad (49)$$

Continuing to calculate the Promedium Viscosity, the initial Mix Viscosity is mu0=Mix Viscosity Loop Calculate Temperature as hereabove at the depth H:

$$TempC = \text{Well_Head_Temperature} + H*\frac{\text{Bottom_Hole_Temperature}-\text{Well_Head_Temperature}}{\text{Perforation Depth}} \quad (50)$$

The Mix Viscosity is calculated again at the temperature TemC which corresponds to the viscosity at the height H:

mu=Mix Viscosity

According to the present invention, an average value is calculated between the current two viscosities, i.e., mu and mu0, $$m=(mu+mu0)/2;$$

and the difference between the two heights being managed Initial. The argument of the integral function is accumulated:

imudh=(m*dh)+imudh; // integral of Mu*dh

Then, the value of initial viscosity is adjusted to calculate the next piece of tubing string:

mu0=mu;

End of Loop

It will be understood that the Loop is executed from the first point, i.e., the Well Head to the final point, i.e., the Pump Setting Depth. Next the Integral is calculated:

$$\text{Viscosity}=\text{imudh}/(\text{Final_Depth-Initial_Depth}); \quad (51)$$

The procedure in the Initial Viscosity Calculation herein referenced as VISCO1.

VISCO1:

$$tk1=(\text{Well Head Temperature}-32)/1.8+273.16 \quad (52)$$

$$tk2=(\text{Bottom Hole Temperature}-32)/1.8+273.16 \quad (53)$$

$$d1=0.000343*(60-\text{Well Head Temperature})+141.5/(131.5+\text{API}) \quad (54)$$

$$d2=0.000343*(60-\text{Bottom Hole Temperature})+141.5/(131.5+\text{API}) \quad (55)$$

$$v1=\text{Well Head Viscosity}/d1 \quad (56)$$

$$v2=\text{Bottom Hole Viscosity}/d2 \quad (57)$$

$$a=(\log(\log(v1+0.7))-\log(\log(v2+0.7)))/\log(tk1/tk2) \quad (58)$$

$$trk=tk2 \quad (59)$$

$$vr=v2 \quad (60)$$

$$tk=(\text{Current Temperature}-32)/1.8+273.16 \quad (61)$$

$$\text{Current Temperature depends from the depth auxiliary variable}=e^{(a*\log(tk/trk)+\log(\log(vr+0.7)))} \quad (62)$$

$$v=e^{(\text{auxiliary valriable})}-0.7 \quad (63)$$

$$d=0.000343*(60-\text{Current_Temperature})+141.5/(131.5+api) \quad (64)$$

$$\text{Viscosity}=(v)*(d) \quad (65)$$

It will be understood that this promedium viscosity is calculated assuming linear dependence between density and temperature. Of course, this procedure might be used instead of integrating it: the assumption would be that the diluent and the oil are totally miscible. If there is no dilute injection bottom hole, then the viscosity can be integrated via VISCO I hereinbefore described.

According to the present invention, the following procedure has been found to be useful for calculating fluid density under well operating conditions. The plurality of input parameters necessary are: last theoretical or practical pump slippage, pressure at the point the density is to be calculated, temperature at the point the density is to be calculated, dilute fraction at the point density is to be calculated (0 if not injected), qqg=volume of free gas above the pump (estimated by correlation), oil specific gravity, dilute specific gravity, gas specific gravity, water specific gravity, water cut, psep, tsep, rssep, bottom hole static pressure, gas oil ratio, bubble point pressure, bottom hole temperature.

Procedure:

Calculation of Oil Volumetric Factor:

$$bov=\text{Volumetri_Factor_Lib(Pressure, Temperature, Gas_Specific_Gravity, Oil_API, psep, tsep, rssep, Bottom_Hole_Pressure, Gas_Oil_Ratio, Bubble_Point_Pressure, Bottom_Hole_Temperature)} \quad (66)$$

Calculation of the Gas Volumetric Factor:

$$bgas=\text{Gas_Volumetri_Factor(Pressure, Temperature, Gas_Specific_Gravity)} \quad (67)$$

Amount of Liquid:

$$qql=(\text{Oil_Fraction}*bov+\text{Water_Cut}+\text{Dilute_Fraction})/\text{Oil_Fraction} \quad (68)$$

Calculation of the Holdup:

$$\text{holdup}=qql/(qql+qqg);\ \text{without slippage in the ideal situation} \quad (69)$$

$$\text{holdup}=\text{Slippage}+(1-\text{Slippage})*\text{holdup};\ \text{with slippage} \quad (70)$$

Calculation of the RS Factor for the gas:

$$rsv=\text{RS(Pressure, Temperature, psep, tsep, Gas_Specific_Gravity, Oil_API, rssep, Bottom_Hole_Pressure_Gas_Oil_Ratio, Bubble_Point_ Pressure, Bottom_Hole_Temperature)} \quad (71)$$

Density of the oil:

$$rhoo=(62.4296*\text{Oil_Speific_Gravity}+0.076366*rsv*\text{Gas_Specific_Gravity})(bov)\ \text{calculated in lbs/ft3} \quad (72)$$

$$b1=1-\text{Oil_Fraction}+\text{Oil_Fraction}*bov;\ \text{for Volumetric Factor Liquid} \quad (73)$$

$$fw=\text{Water_Cut}/bl;\ \text{for percentage of water} \quad (74)$$

$$fd=\text{Dilute_Fraction}/bl;\ \text{for percentage of dilute} \quad (75)$$

$$fo=\text{Oil_Fraction}/bl;\ \text{for percentage of oil} \quad (76)$$

Density of the whole liquid:

$$rhol=rhoo*fo+62.4296*(\text{Water_Specific_Gravity}*fw+\text{Dilute_Specific_Gravity}*fd) \quad (77)$$

Density of the gas:

$$rhog=dengas(\text{Pressure, Temperature, Gas_Specific_Gravity}) \quad (78)$$

Based upon these predecessor parameters, the Mixture Density may be calculated:

$$\text{Density}=rhol*\text{holdup}+rhog*(1-\text{holdup}) \quad (79)$$

End

It will be appreciated by those skilled in the art, that several procedures depend from the hereinbefore described Density Calculation Procedure:

Volumetric Factor:

The plurality of Volumetri_Factor Parameters consist of: Gas_Specific_Gravity, Oil_API, psep (Separator Pressure if indicated and Well Head Pressure if not), tsep (Separator Temperature if Indicated and Well Head Temperature if Not), rssep (RS factor in Separator if Indicated and 0 if not), Bottom_Hole_Pressure, Gas_Oil_Ratio, Bubble_Point_Pressure, Bottom_Hole_Temperature).

double sgo,co,rsv,pbt,bov,sg100;

Calculation of the Factor for correction of the volumetric factor:

sg100=Gas Specific_Gravity*(1+0.1595*Oil_API)*tsep )*log 10((psep+14.7)/114.7));

$$sg100 = \text{Gas_Specific_Gravity}*(1+).1595*\text{Oil_API}^{0.4078})*(tsep^{-0.2466})*\log10\frac{psep+14.7}{114.7} \quad (80)$$

Oil Specific Gravity:

$$sgo=141.5/(131.5+\text{Oil_API}) \quad (81)$$

Calculation of the RS Factor:

$$rsv=rs(\text{Pressure, Temperature, psep, tsep, Gas_Specific_Gravity, Oil_API, rssep, Bottom_Hole_Pressure, Gas_Oil_Ratio}, pb, tr)$$

Calculation of the Bubble Point at the temperature:

$$pbt=fnpbt(\text{Bubble_Point_Pressure, Temperature, Bottom_Hole_Temperature}) \quad (82)$$

if Pressure<=pbt

// use Glasso correlation.recommended by University of Tulsa for API<20

$$bov = rsv*\left(\frac{\text{Gas_Specific_Gravity}}{sgo}\right)^{0.526} + 0.9688*\text{Temperature} \quad (83)$$

$$bov=-6.58511+2.91329*\log 10(bov)-0.27683*(\log 10(bov))^2 \quad (84)$$

$$bov=1+10^{bov} \quad (85)$$

else $$bov = rsv*\left(\frac{\text{Gas_Specific_Gravity}}{sgo}\right)^{0.526} + 0.9688*\text{Temperature} \quad (86)$$

$$bov=-6.58511+2.91329*\log 10(bov)-0.27683*(\log 10(bov))^2 \quad (87)$$

$$bov=1+10^{bov} \quad (88)$$

$$co=\log 10(6.8257)+0.5002*\log 10(rsv)+0.3613*\log 10(\text{Oil_API})+0.7606*\log 10(\text{Temperature}) \quad (89)$$

$$co=co-0.35505*\log 10(sg100) \quad (90)$$

$$co = \frac{10^{co}}{(Pressure+14.7)}\Big/1000\Big/1000 \quad (91)$$

$$bov=bov*e^{co*(pbt-Pressure)} \quad (92)$$

Calculation of the Factor RS:

Plurality of parameters include: Pressure, Temperature, psep (same as hereinabove), tsep (same as hereinabove), Gas_Specific_Gravity, Oil_API, rsep (same as hereinabove), Bottom_Hole_Pressure, Gas_Oil Ratio, Bubble Point Pressure, Bottom Hole Temperature. Factor for Compensating the Gas Specific Gravity:

sg100=Gas Specific Gravity*(1+0.1595*Oil_API )*( tsep)*log 10((psep+14.7)/114.7));

$$sg100 = \text{Gas_Specific_Gravity}*(1+).1595*\text{Oil_API}^{0.4078})*(tsep^{-0.2466})*\log10\left(\frac{psep+14.7}{114.7}\right) \quad (93)$$

$$rss=\text{Oil_API}/(\text{Temperature}+459.67) \quad (94)$$

Bubble Point Pressure calculation at the temperature T:

pbt=fnpbt(Bubble Point Pressure, Temperature, Bottom Hole Temperature)

If Bubble Point is Greater than Static Bottom Hole Pressure

If(pbt>Bottom_Hole_Pressure)

At most Pressure can be equal to the Bottom Hole Pressure

If Oil_API<=30

$$rss=0.5958*sg100^{0.7972}*(p+14.7)^{1.0014}*10^{13.1405*rss} \quad (95)$$

else $$rss=0.0315*sg1000.1787*(p+14.7)^{1.0937}*10^{11.289*rss} \quad (96)$$

If(Pressure>Bottom_Hole_Pressure)

$$rsly = |\text{Gas_Oil_Ratio}+rssep-rss|*\frac{(\text{Pressure}-\text{Bottom_Hole_Pressure})}{(pbt-\text{Botoom_Hole_Pressure})} \quad (97)$$

else rsly=0

$$rss=rss+rsly \quad (98)$$

else

If Pressure<psep $$rss=rssep \quad (99)$$

else

If Pressure<pbt $$rss=rssep+\text{Gas_Oil_Ratio}*(\text{Pressure}-psep)/(pbt-psep) \quad (100)$$

else $$rss=rssep+\text{Gas_Oil_Ratio} \quad (101)$$

If (rss>rssep+Gas_Oil_Ratio)

$$rss=rssep+\text{Gas_Oil_Ratio} \quad (102)$$

It should be evident to those skilled in the art that the final value for RS is rss under the teachings of the present invention.

Calculation of the Bubble Point at the Temperature T:

For the bubble point calculation, the following parameters are implicated: Bubble Point Pressure at Bottom Hole Temperature(Reservoir conditions), Temperature at which the Bubble Point Pressure is unknown, Bottom Hole Temperature or Reservoir Temperature. For Bubble Point Pressure unknown scenario, the calculation proceeds:

$$10^{\log 10(\text{Bubble Point Pressure})*\frac{(\text{Bottom Hole Temperature}+460)}{(\text{Temperature}+460)}} \quad (103)$$

Returning to PLC Rules and Procedures, consider Analysis 2 corresponding to well head pressure analysis,

```
Events: Hi-Normal-Limit Exceeded: 1.15*K6
    count1 = count1 + 1
    if count1 >3 Shut_Down and Reset count Generate Alarm and
                Exit Loop
    else    Decrease RPMs    (Decrease A01)
            Wait for Recovery Time
    Loop
Lo-Normal-Limit: 0.85*K6
    count2 = count2 + 1
    if count2 >3 SHUT_DOWN and Reset count Generate Alarm and
                        Exit Loop
    else    Decrease RPMs    (Decrease A01)
            Wait for Recovery Time
    Loop
```

Rule 1 for parted rods detection:

If CALC1<K1*CALC4@INPUT1=0

Shut_Down and Generate Alarm and Exit Loop

Procedure 1 for pump slippage calculation:

If not Shut_Down

Shut_Down

While CALC1>0.85*CALC6 or Time_Elapsed<30 seconds

Continue to ARRAY[i]=CALC1

Store ARRAY[i] and Teime StampA1 [i]

Loop

Exit Procedure

Figure 7:
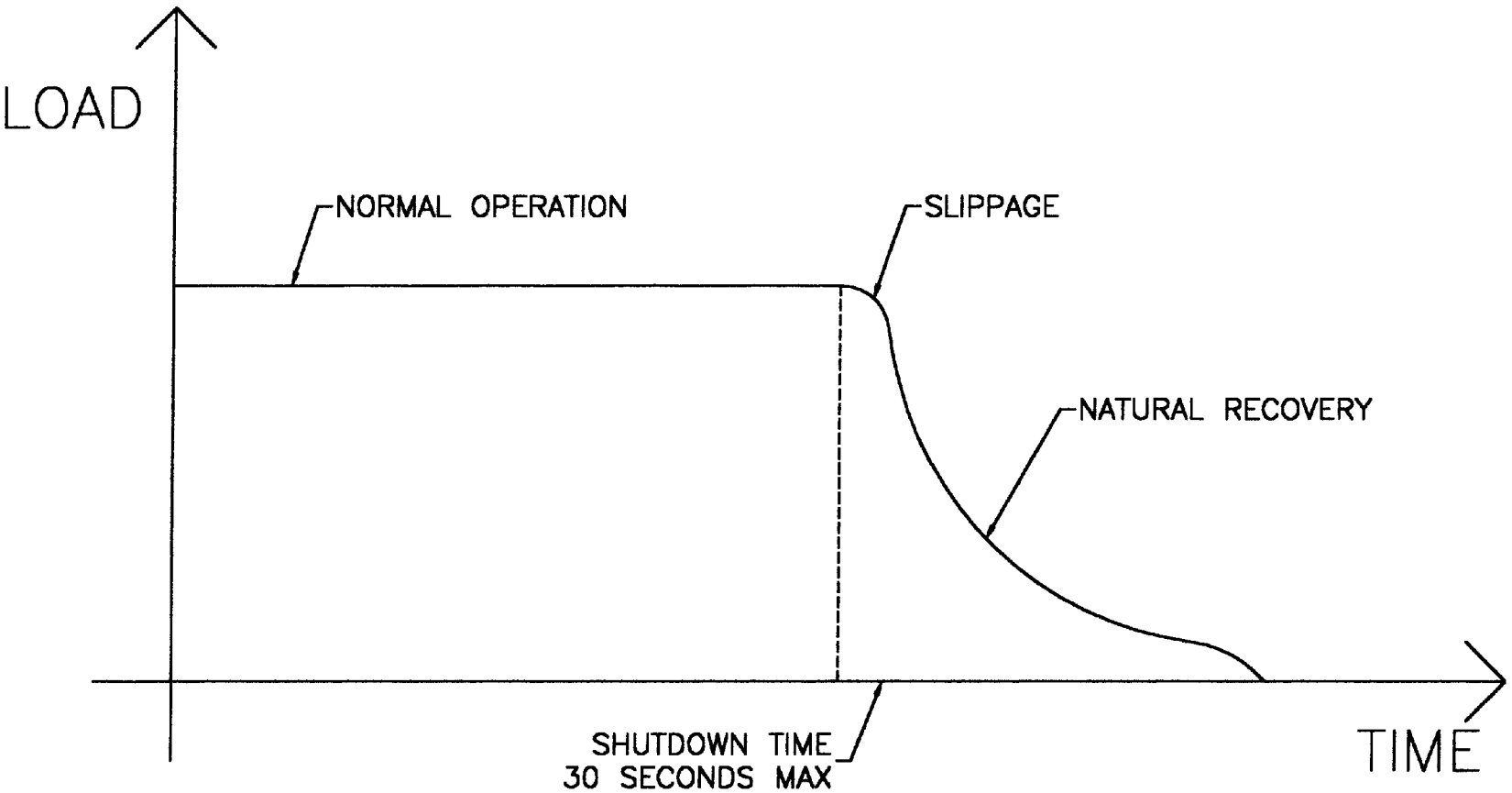
FIG. 7 depicts a simplified plot of load versus time showing pump slippage treatment under the present invention.

Thus, the system is shutdown upon request of this procedure (Procedure 1). Referring to FIG. 7, the axial load is to be registered with its time stamp, in order to know what the load gradient vs time. The braking system must be functioning to keep the pump from losing the fluid column. During the very first 30 seconds after shutdown, the load and its time stamp is measured. As known the Load is given by:

$$\text{Load}=\text{PUMP_AREA}*(\text{Fluid_Level}*\text{Fluid_Gradient}+\text{Well_Head_Pressure})+\text{Weight_of_Rods_on_Air}*\text{BF@0 RPM}) \quad (104)$$

substituting the fluid level (and the column associated to the Well Head Pressure) with an equivalent Fluid Column H:

$$\text{Load}=\text{PUMP_AREA}*(\text{HFluid_Gradient}+\text{Weight_of_Rods_on_Air}*\text{BF@0 RPM}) \quad (105)$$

Now differentiating with respect the time:

$$dLoad/dt=dH/dt*\text{Fluid_Gradient}*\text{PUMP_AREA} \quad (106)$$

isolating dH/dt and multiplying by the annular space area (between Tubing and Rods: Asa):

$$dH/dt*Asa=dLoad/dt*(Asa/(\text{Fluid_Gradient}*\text{PUMP_AREA})) \quad (107)$$

the variation of the Volume V displaced due to the variation of a column H is dV=Asa*dH and the rate associated to that volume is Q=dV/dt. Therefore:

$$Qslippage=dLoad/dt*(Asa/(\text{Fluid_Gradient}*\text{PUMP_AREA}) \quad (108)$$

where dLoad/dt can be approximated to the average speed of variation (in intervals) of the measures taken by the PLC, upon request of this procedure.

It will be understood that the pump slippage is to be determined under operating conditions. The operating condition for the pump means is when a close value to the Nominal Load is supported by the pump means. On the other hand, experimentally it is considered that the well is completely restored 30 seconds after SHUTDOWN. These are the two main reasons why the operating pump slippage is measured immediately after shutdown, i.e., this is the closest value to the Nominal Load for the pump under shutdown conditions, but within 30 seconds after shutdown, i.e., the well is not restored yet. This Operating Pump Slippage may be compared to a theoretically determined operating Slippage (via the pump characteristics) and prematurely, a pump WORN OUT condition can be detected.

Rule 2 for current detection:

Hi-Normal-Limit Exceeded: K18*1.30

Shut_Down and Generate Alarm and Exit Loop

Loop

Lo-Normal-Limit: K18*0.7

Shut_Down and Generate Alarm and Exit Loop

Loop

For illustrative purposes, the following is a general step-by-step installation of a progressive cavity pump system contemplated by the present invention. In step 1, the stator is attached to the first joint of the production tubing string. Then, the operator sequentially installs subsequent joints of tubing until the stator is at the required setting depth. Next, the operator secures the tubing in the well using conventional methods known in the art. In step 2, the rotor is attached to the first rod of the production sucker rod string. Then, the rotor and sucker rod are inserted into the interior of the production tubing. Next, the other sucker rod sections are attached to the production rod string and the rotor is lowered to the stator depth. As will be appreciated by those skilled in the art, the rotor will pass through the interior of the stator and will then rest on the stop-pin. In step 3, the rig pulls the production sucker rod string upwardly until all of the slack therein is removed. Then, the operator marks the sucker rod string indicating its position compared with the surface tubing elevation. Calculations are next made to determine the amount that the sucker rods in the well will stretch during dynamic pump operation. The well service rig then pulls up the sucker rod string and the final sucker rod element is length-adjusted with short sucker rod lengths, i.e., with "pony rods," to compensate for the expected length of sucker rod stretch and associated distance to the stator stopp-in. Critically spacing of the rotor in the stator has now been achieved. In step 4, the drive head is attached to the production tubing and then secured to the well as required.

It will be understood that installation of the pump optimization system taught by the present invention will vary somewhat for each individual application. The systems' remote instrumentation and I/O device's and concomitant processor may be housed in some various containment peripherals such as NEMA-rated fiberglass or metallic enclosures. Process input devices incorporated into the preferred embodiment as hereinbefore described consist of three transducers of various ranges. Additionally, the drive head contains a strain gauge. Each device will usually be a two-wire 4–20 Ma current input signal. Additional instrumentation elements required based upon site constraints or by the operator may be provided and connected to the system. As will be appreciated by those skilled in the art, local and national wiring codes should govern the installation and selection of shielded cables used. Marshaling of the process input signals may be performed when a single multiconductor cable bridges the remote terminal unit with the process system (having RTU, PLC, etc.) at the well site.

It will also be appreciated that the point of tap for transducers will vary from application to application. At the very minimum pressure, transducers should preferably be mounted in a vertical disposition and perpendicularly of the process line being monitored. The transducer leads, as hereinbefore stated, should meet local and national codes and is usually client-driven for a particular application.

To benefit from the teachings of the present invention, of course, the computer system connections including the ACU and the motor controller must be properly installed. The RTU/PLC should be directly connected to the ACU preferably via hard wire serial cabling or by using a conventional radio telemetry system. System designs for a duster (multiple) and singular applications may be used and, of course, vary significantly. Field connections should preferably be made between the RTU/PLC and the motor speed control via wire analog or serial control conventions.

Field testing of the present invention has enabled pump optimization to be attained to the extent heretofore unknown in the art. FIGS. 8–11 show the results of such an actual field test. The values depicted represent actual responses and are not adjusted or embellished mathematically: the values shown represent the relationships indicated. The axial bearing loads reflect variances from the nominal bearing load at static well conditions. The fluid levels represent variances in feet above the suction of the pump compared with static fluid levels. Static conditions occur when the pump is shut down and the oil or gas well is allowed to reach a stage of stasis or equilibrium. Test responses gave very good representative values for the relationship between axial bearing load and fluid level.

Figure 8:
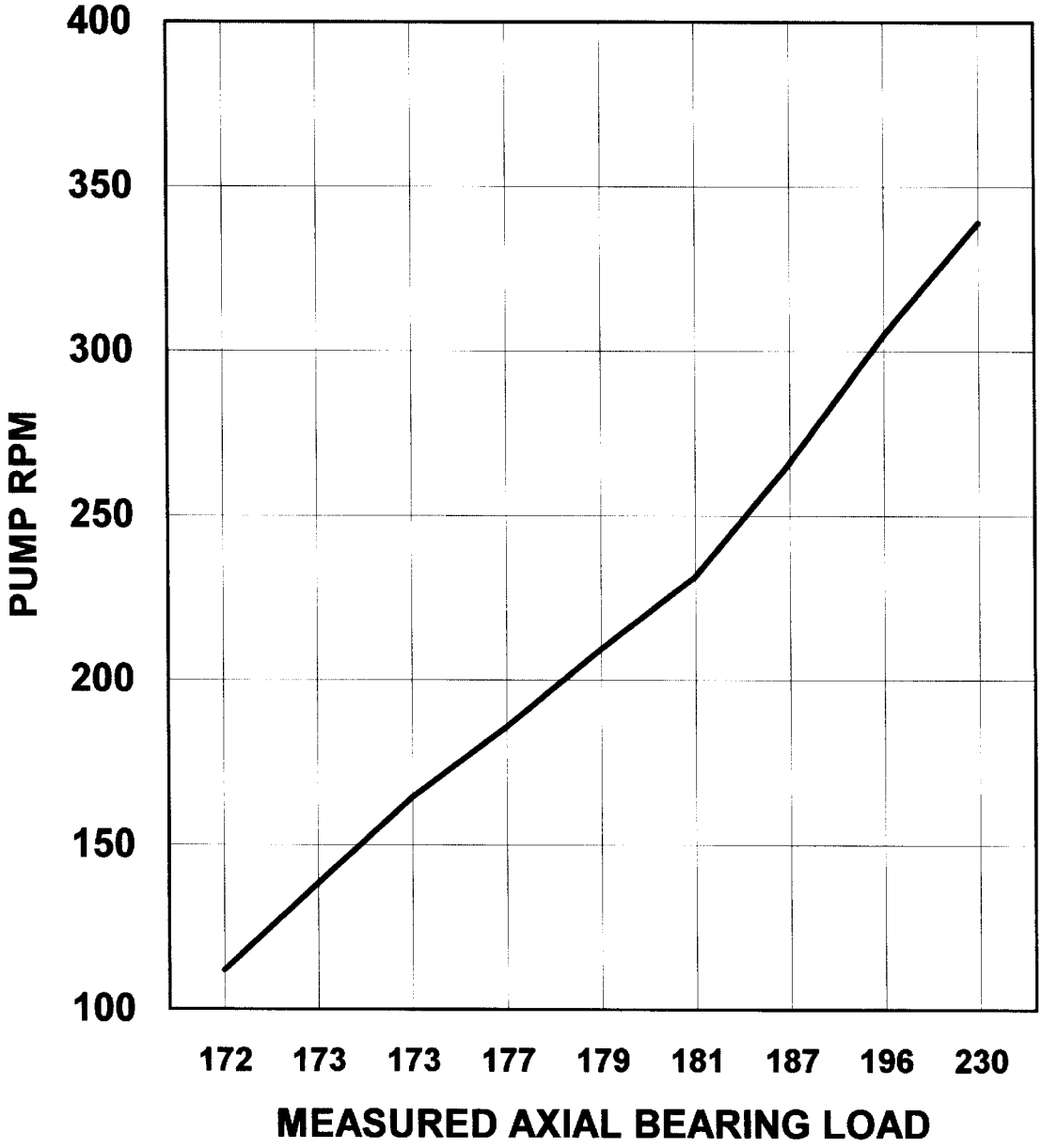
FIG. 8 depicts a plot of pump RPM versus measured axial bearing load for a pumping system performing under the present invention.

Specifically referring to FIG. 8, there is depicted a plot of pump RPM versus measured axial bearing load, as RPM is increased. Thus, the relationship between measured axial bearing loads—corresponding to the thrust from the sucker rod and pump hydraulic loads—and pump speed. As is known in the art, the pump RPM has a direct relationship to pump fluid production. As the RPM increases, the pump flow increases proportionately. This plot suggests an increase in an axial bearing load as pump RPM/flow rate increases, which proves the existence of a mechanical relationship to the increasing hydraulic load due to pump flow rates.

Figure 9:
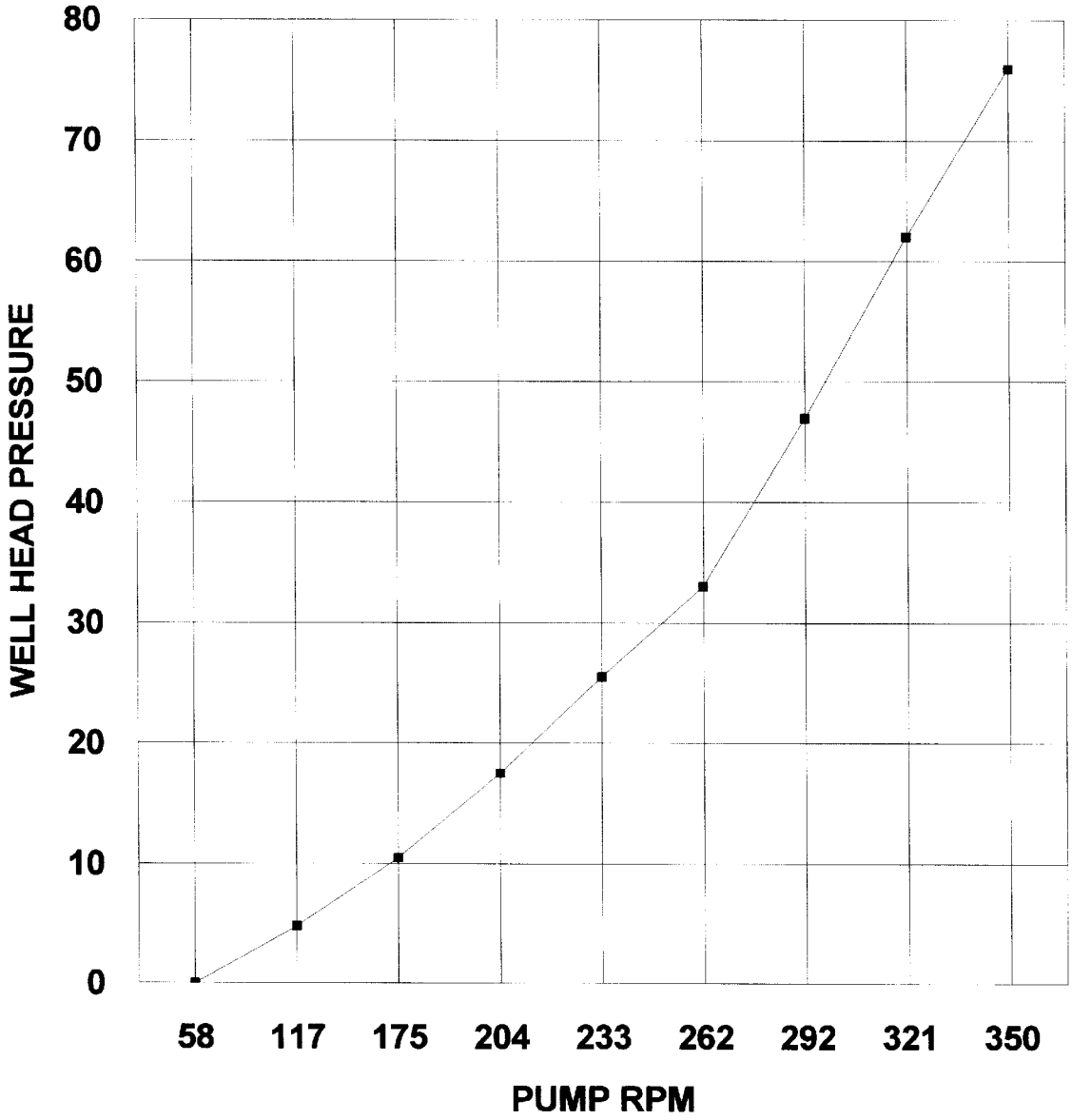
FIG. 9 depicts a plot of well head pressure versus pump RPM for a pumping system performing under the present invention.
Figure 10:
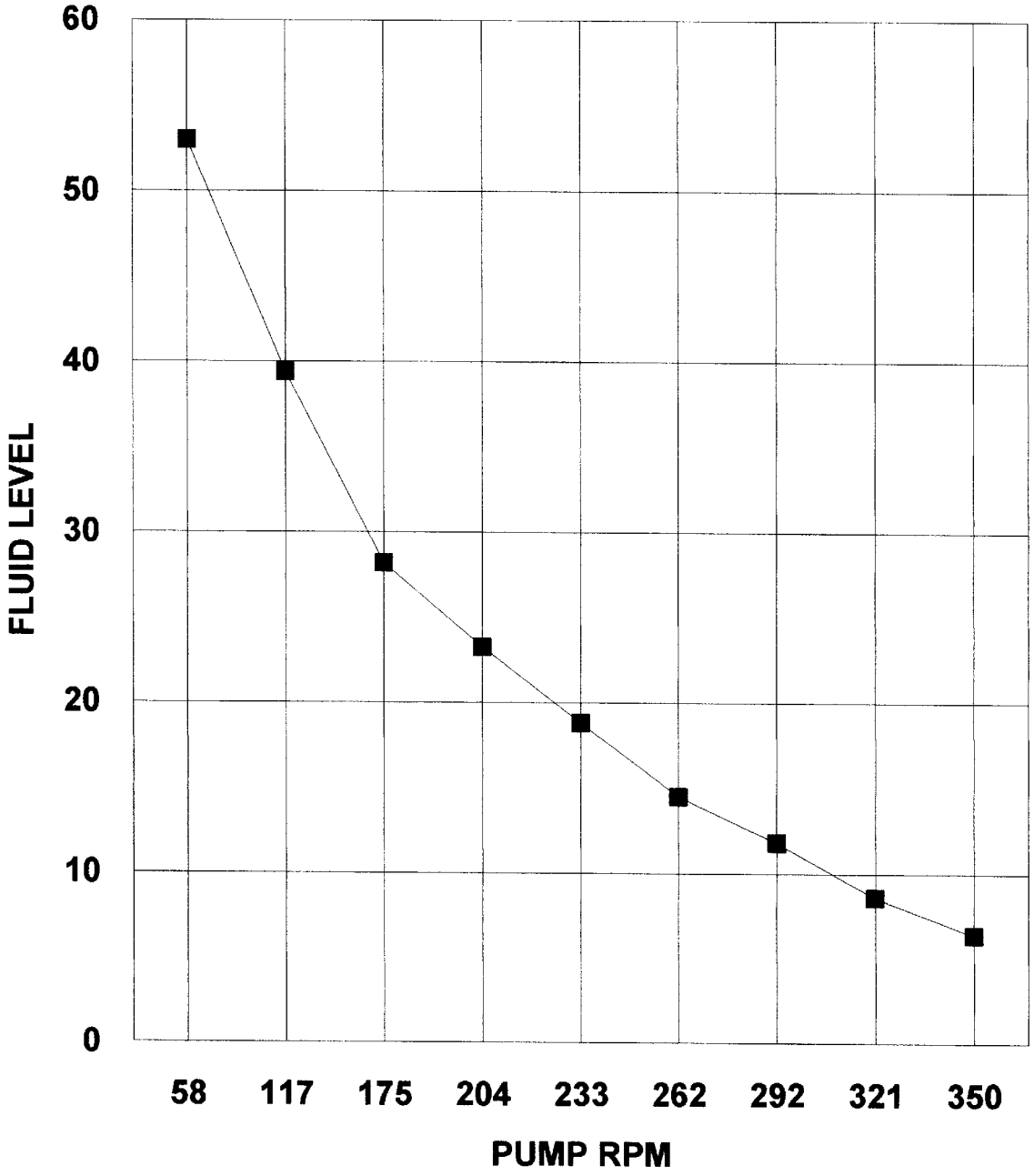
FIG. 10 depicts a plot of fluid level versus pump RPM for a pumping system performing under the present invention.

Now referring to FIG. 9, the relationship between pump surface discharge pressure and pump RPM or flow rates is shown. The increase in surface pressure depicted is a result of flow line back pressure. It will be understood that the increased back pressure has a mechanical relationship to a hydraulic load generated at the pump. These results thus substantiate the requirement for compensation for this relationship in the prescribed calculation for establishing fluid levels. FIG. 10 shows the relationship between pump RPM/flow rate and fluid level. As the pump flow rate increases, the fluid level drops clearly showing the well response to increased pump discharge. Accordingly, this plot proves the premise that increasing or decreasing pump RPM can control fluid level.

Figure 11:
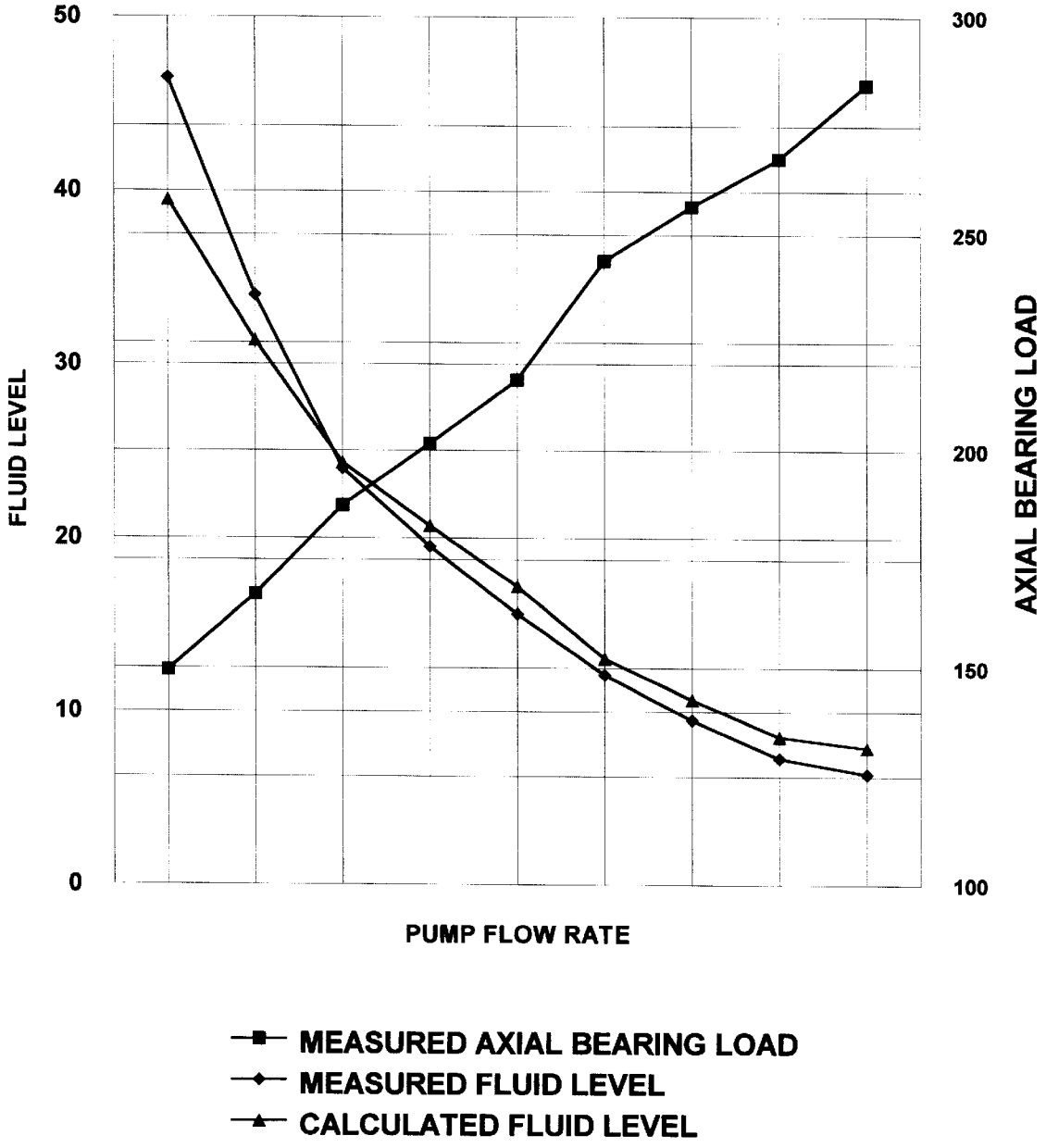
FIG. 11 depicts a plot of fluid level versus pump flow rate for a pumping system performing under the present invention.

Now referring to FIG. 11, there is seen the relationship between axial bearing thrust load and fluid level. The value for fluid level is indicated by a data line from measured fluid levels—obtained from sonic fluid level measurements—in the well. Also depicted therein are calculated values generated from the preferred embodiment as hereinbefore described in detail. Thus, the relationship shown proves the mechanical relationship between fluid level and axial bearing load. The calculated fluid level has been generated from the axial bearing load using the formula taught by the present invention. It should be evident that the calculated value proves the accuracy and viability of the present invention for optimizing pump performance as contemplated hereunder. The ability to use these values from historic axial load measurements to assess, analyze, control, and predict well performance is heretofore unknown in the art.

Figure 12:
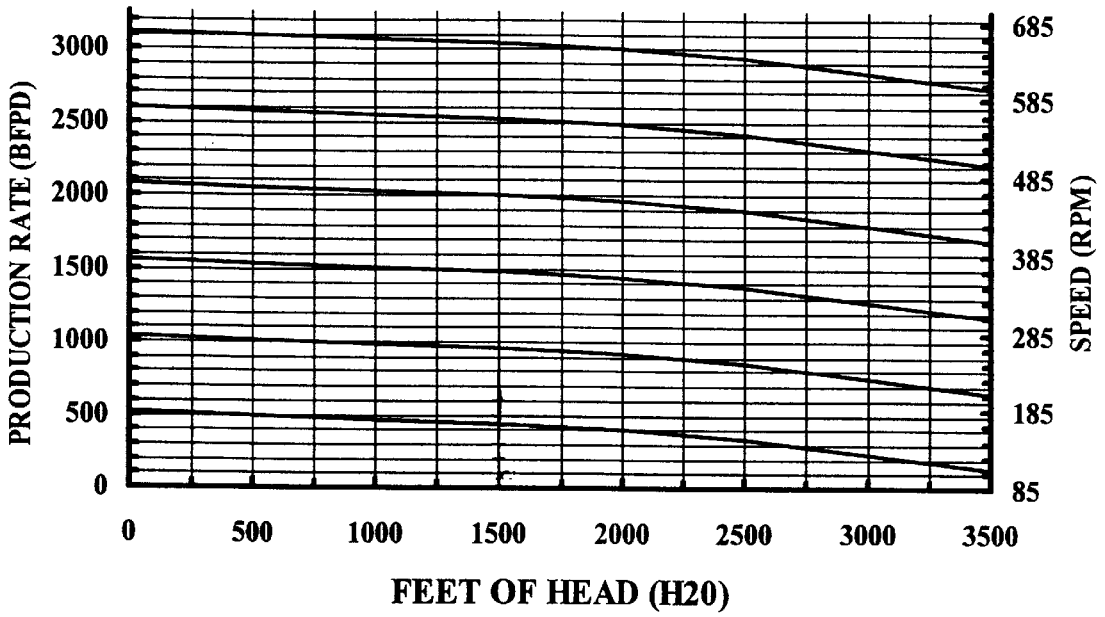
FIG. 12 depicts a plot of pump performance versus feet of head of water.
Figure 12:
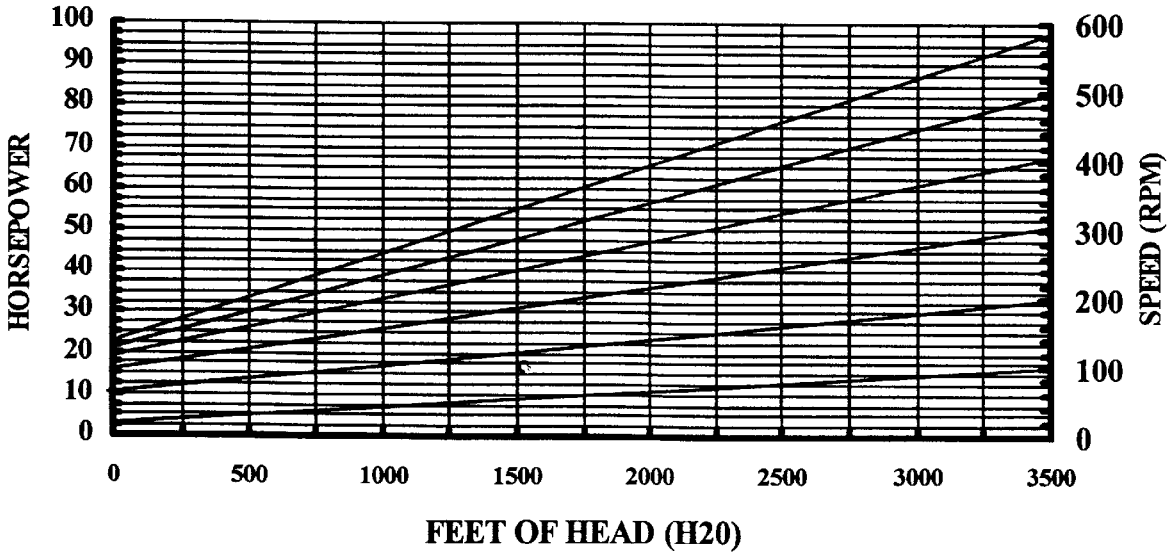

The heightened performance achieved by the present invention as hereinbefore described in detail is shown in FIG. 12. Performance is depicted both as a plot of production rate versus feet of head of water and, alternatively, as horsepower versus feet of head. The data shown is based upon 100° F. water. The relationship between performance and dynamic fluid level taught by the present invention is clear.

Other variations and modifications will, of course, become apparent from a consideration of the specific embodiment and illustrative examples hereinbefore described. Accordingly, it should be clearly understood that the present invention is not intended to be limited by the particular disclosure, embodiment and examples hereinbefore described and depicted in the accompanying drawings, but that the concept of the present invention is to measured by the scope of the appended claims herein.

What is claimed is:

1. In an oil or gas recovery well having pump means and interconnected pump control means, motor means for driving said pump means, drive head means, and a downhole production tubing assembly and a sucker rod string assembly contained within a well caseing means, a system for monitoring real-time pump performance and for optimizing such pump performance, said system comprising:

a plurality of sensor means disposed along said downhole production tubing and sucker rod string for collecting data functionally related to said pump performance;

a computer system interconnected with said plurality of sensor means and said pump control means for storing said data in a database, and for optimizing operation of said pump means by controlling said pump control means on the basis of a functional relationship between axial load and dynamic fluid level in said well.

2. The system recited in claim 1, wherein said plurality of sensor means comprises a surface discharge pressure sensor attached to a production line disposed perpendicularly of said downhole production tubing assembly and said sucker rod string assembly, a caseing pressure sensor disposed on the annular space between said downhole production tubing assembly and said caseing means, an axial load measuring means and motor current measuring means disposed upon said drive head means.

3. The system recited in claim 1, wherein said computer system comprises:

programmable logic controller means electrically interconnected with said plurality of sensor means for providing local control of said well pump conditions based upon a first set of rules;

communications link means electrically interconnected with said programmable logic controller means and a variable frequency drive means for controlling the speed of said motor means; and advanced control means for providing an expert system for performing real-time performance and productivity analysis of said data stored in said database based upon a second set of rules and for providing a user interface means for enabling an operator to conveniently interface with said computer system.

4. The system recited in claim 3, wherein said computer system further comprises:

remote control means electrically interconnected with said plurality of sensor means for providing remote control of said well pump conditions.

5. The system recited in claim 3, wherein said second set of rules of said expert system of said computer system further comprises:

procedures for preemptive warnings of potential pump failures and conditions for immediate, automatic shutdown of said well.

6. The system recited in claim 3, wherein said second set of rules of said expert system of said computer system further comprises:

procedures for automatic adjustment of RPM of said pump means and a check-cycle for assuring that system RPM was properly adjusted.

7. The system recited in claim 3, wherein second set of rules of said expert system of said computer system further comprises:

procedures for diagnosing well events.

8. The system recited in claim 3, wherein said computer system further comprises:

procedures for generating explanatory information corresponding to real-time well conditions and pump performance.

9. The system recited in claim 3, wherein second set of rules of said expert system of said computer system further comprises:

procedures for establishing real-time operating parameters for optimizing performance of said pump means.

10. The system recited in claim 3, wherein second set of rules of said expert system of said computer system further comprises:

a dynamic knowledge base of historic well data and operational parameters compiled from said real-time analysis of said data stored in said database.

* * * * *